US011531288B2

(12) United States Patent
Yamada

(10) Patent No.: US 11,531,288 B2
(45) Date of Patent: Dec. 20, 2022

(54) IMAGE FORMING APPARATUS

(71) Applicant: Oki Electric Industry Co., Ltd., Tokyo (JP)

(72) Inventor: Shin Yamada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/405,385

(22) Filed: Aug. 18, 2021

(65) Prior Publication Data

US 2022/0091537 A1 Mar. 24, 2022

(30) Foreign Application Priority Data

Sep. 23, 2020 (JP) ..... JP2020-159084

(51) Int. Cl.
*G03G 15/00* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/38, 50, 53, 55
See application file for complete search history.

(56) References Cited

U.S. PATENT DOCUMENTS

| | | | | |
|---|---|---|---|---|
| 9,417,555 | B2 * | 8/2016 | Mitsunobu | G03G 15/065 |
| 9,709,918 | B1 | 7/2017 | Kuribayashi et al. | |
| 2014/0255053 | A1 | 9/2014 | Ohshika | |

FOREIGN PATENT DOCUMENTS

| | | | |
|---|---|---|---|
| EP | 2998796 | A1 | 3/2016 |
| JP | 2022038299 | * | 3/2000 |
| JP | 3604573 | B2 | 12/2004 |
| JP | 2018-084677 | A | 5/2018 |

* cited by examiner

*Primary Examiner* — Hoan H Tran
(74) *Attorney, Agent, or Firm* — Rabin & Berdo, P.C.

(57) ABSTRACT

An image forming apparatus includes: a first developing member that develops a first toner image on a first image carrier with a brilliant toner containing a flat pigment; a second developing member that develops a second toner image on a second image carrier with a non-brilliant toner containing no brilliant pigment; and a controller that controls the first developing member and the second developing member. The controller controls a development efficiency of the brilliant toner of the first developing member to be lower than a development efficiency of the non-brilliant toner of the second developing member.

15 Claims, 11 Drawing Sheets

FIG. 7

T11

| CONDI-TION | BIAS [V] | | | | | BIAS DIFFERENCE [V] | | DEVELOP-MENT EFFICIENCY [%] |
|---|---|---|---|---|---|---|---|---|
| | CHARGING ROLLER (VCH) | DEVELOPING ROLLER (VDB) | SUPPLY ROLLER (VSB) | PRIMARY TRANSFER ROLLER (VTR1) | SECONDARY TRANSFER ROLLER (VTR2) | CHARGING - DEVELOPING (VCH-VDB) | DEVELOPING - SUPPLY (VDB-VSB) | |
| C11 | -800 | -100 | -374 | -1167 | -828 | 700 | 274 | 25.4 |
| C12 | -825 | -100 | -374 | -1167 | -828 | 725 | 274 | 35.0 |
| C13 | -850 | -100 | -374 | -1251 | -828 | 750 | 274 | 46.5 |
| C14 | -1025 | -100 | -374 | -1251 | -828 | 925 | 274 | 59.4 |
| C15 | -1050 | -125 | -400 | -1260 | -828 | 925 | 275 | 63.5 |
| C16 | -1079 | -155 | -430 | -1278 | -828 | 924 | 275 | 72.7 |
| C17 | -1110 | -185 | -460 | -1220 | -828 | 925 | 275 | 80.1 |
| C18 | -1139 | -215 | -490 | -1346 | -828 | 924 | 275 | 83.9 |
| C19 | -1170 | -245 | -520 | -1336 | -828 | 925 | 275 | 90.4 |

FIG. 8

T12

| CONDITION | DEVELOP-MENT EFFICIENCY [%] | TONER DEPOSITION AMOUNT [mg/cm$^2$] | | FOG | | ΔY | FI VALUE | EVALU-ATION |
|---|---|---|---|---|---|---|---|---|
| | | PHOTO-SENSITIVE DRUM | SHEET | FOG VALUE (ΔE) | SHEET FOG LEVEL | | | |
| C11 | 25.4 | 0.29 | 0.05 | 0.52 | 8 | −3.90 | 6.5 | POOR |
| C12 | 35.0 | 0.40 | 0.14 | 0.41 | 9 | −16.45 | 16.7 | POOR |
| C13 | 46.5 | 0.53 | 0.21 | 0.29 | 9 | −20.96 | 16.7 | GOOD |
| C14 | 59.4 | 0.67 | 0.27 | 0.30 | 9 | −25.04 | 14.6 | GOOD |
| C15 | 63.5 | 0.72 | 0.27 | 0.31 | 9 | −25.77 | 14.7 | GOOD |
| C16 | 72.7 | 0.82 | 0.31 | 0.20 | 9 | −26.25 | 14.6 | GOOD |
| C17 | 80.1 | 0.90 | 0.33 | 0.52 | 8 | −27.82 | 13.4 | GOOD |
| C18 | 83.9 | 0.95 | 0.35 | 0.70 | 7 | −27.65 | 13.3 | POOR |
| C19 | 90.4 | 1.02 | 0.40 | 0.79 | 7 | −28.98 | 13.2 | POOR |

FIG. 9

T21

| CONDI-TION | BIAS [V] | | | | | BIAS DIFFERENCE [V] | | DEVELOP-MENT EFFICIENCY [%] |
|---|---|---|---|---|---|---|---|---|
| | CHARGING ROLLER (VCH) | DEVELOPING ROLLER (VDB) | SUPPLY ROLLER (VSB) | PRIMARY TRANSFER ROLLER (VTR1) | SECONDARY TRANSFER ROLLER (VTR2) | CHARGING - DEVELOPING (VCH-VDB) | DEVELOPING - SUPPLY (VDB-VSB) | |
| C21 | −800 | −100 | −405 | −1167 | −828 | 700 | 305 | 12.6 |
| C22 | −824 | −100 | −405 | −1167 | −828 | 724 | 305 | 38.0 |
| C23 | −851 | −100 | −405 | −1251 | −828 | 751 | 305 | 45.8 |
| C24 | −1025 | −100 | −405 | −1251 | −828 | 925 | 305 | 63.5 |
| C25 | −1050 | −125 | −429 | −1260 | −828 | 925 | 304 | 67.5 |
| C26 | −1080 | −155 | −460 | −1278 | −828 | 925 | 305 | 71.9 |
| C27 | −1111 | −185 | −489 | −1220 | −828 | 926 | 304 | 83.2 |
| C28 | −1140 | −215 | −520 | −1346 | −828 | 925 | 305 | 90.8 |
| C29 | −1170 | −245 | −550 | −1336 | −828 | 925 | 305 | 94.8 |

FIG. 10

T22

| CONDITION | DEVELOP-MENT EFFICIENCY [%] | TONER DEPOSITION AMOUNT [mg/cm$^2$] | | FOG | | ΔY | FI VALUE | EVALU-ATION |
|---|---|---|---|---|---|---|---|---|
| | | PHOTO-SENSITIVE DRUM | SHEET | FOG VALUE (ΔE) | SHEET FOG LEVEL | | | |
| C21 | 12.6 | 0.16 | 0.04 | 0.99 | 8 | −3.99 | 5.3 | POOR |
| C22 | 38.0 | 0.47 | 0.15 | 0.93 | 8 | −21.78 | 16.8 | GOOD |
| C23 | 45.8 | 0.57 | 0.23 | 0.67 | 8 | −21.89 | 16.7 | GOOD |
| C24 | 63.5 | 0.79 | 0.32 | 0.83 | 8 | −24.22 | 15.9 | GOOD |
| C25 | 67.5 | 0.84 | 0.33 | 1.00 | 8 | −30.33 | 13.4 | GOOD |
| C26 | 71.9 | 0.90 | 0.34 | 0.66 | 8 | −28.50 | 14.8 | GOOD |
| C27 | 83.2 | 1.04 | 0.39 | 0.90 | 8 | −27.11 | 14.5 | POOR |
| C28 | 90.8 | 1.13 | 0.37 | 0.96 | 7 | −30.00 | 13.5 | POOR |
| C29 | 94.8 | 1.18 | 0.39 | 0.80 | 7 | −30.02 | 13.9 | POOR |

IMAGE FORMING APPARATUS

BACKGROUND OF THE INVENTION

1. Field of the Invention

The present invention relates to an image forming apparatus, and is preferably applied to, for example, an electrophotographic printer.

2. Description of the Related Art

Conventionally, there are widely used image forming apparatuses that perform printing processes by forming toner images with toners of respective colors by means of image forming units of the respective colors on the basis of images supplied from computers or the like, transferring the toner images onto media, such as paper sheets, and fixing them by applying heat and pressure.

Also, there has been recently proposed an image forming apparatus that uses a brilliant toner containing a metallic pigment, such as aluminum, to produce printed products with enhanced luster as compared to the case of using a toner containing a normal pigment (see, e.g., Japanese Patent Application Publication No. 2018-84677). For convenience, a color exhibited when brilliant toner is transferred onto a medium, such as a paper sheet, will also be referred to as a brilliant color.

SUMMARY OF THE INVENTION

An aspect of the present invention is intended to provide an image forming apparatus capable of forming an image having sufficient brilliance.

According to an aspect of the present invention, there is provided an image forming apparatus including: a first developing member that develops a first toner image on a first image carrier with a brilliant toner containing a flat pigment; a second developing member that develops a second toner image on a second image carrier with a non-brilliant toner containing no brilliant pigment; and a controller that controls the first developing member and the second developing member, wherein the controller controls a development efficiency of the brilliant toner of the first developing member to be lower than a development efficiency of the non-brilliant toner of the second developing member.

According to another aspect of the present invention, there is provided an image forming apparatus including: a first developing member that develops a first toner image on a first image carrier with a brilliant toner containing a flat pigment; a second developing member that develops a second toner image on a second image carrier with a non-brilliant toner containing no brilliant pigment; a transfer unit that transfers the first toner image and the second toner image onto a transfer body; and a controller that controls the first developing member and the second developing member, wherein when superimposing the first toner image and the second toner image on each other on the transfer body, the controller controls a development efficiency of the brilliant toner of the first developing member to be lower than when forming the first toner image on the transfer body without superimposing the first toner image and the second toner image on each other on the transfer body.

According to another aspect of the present invention, there is provided an image forming apparatus including: a first developing member that develops a first toner image on a first image carrier with a brilliant toner containing a flat pigment; a first charging member that charges the first image carrier; a first supply member that supplies the brilliant toner to the first developing member; and a controller that controls bias voltages applied to the first developing member, the first charging member, and the first supply member, wherein the controller makes a development efficiency of the brilliant toner of the first developing member lower than the development efficiency when the bias voltage applied to the first developing member is −185 V, the bias voltage applied to the first charging member is −1111 V, and the bias voltage applied to the first supply member is −489 V.

BRIEF DESCRIPTION OF THE DRAWINGS

In the attached drawings:

FIG. 7 is a table showing various voltage values of a first condition group;

FIG. 8 is a table showing various measured values and evaluation results under conditions of the first condition group;

FIG. 9 is a table showing various voltage values of a second condition group;

FIG. 10 is a table showing various measured values and evaluation results under conditions of the second condition group;

DETAILED DESCRIPTION OF THE INVENTION

Embodiments of the present invention will now be described with reference to the drawings.

1. Configuration of Image Forming Apparatus

Figure 1:
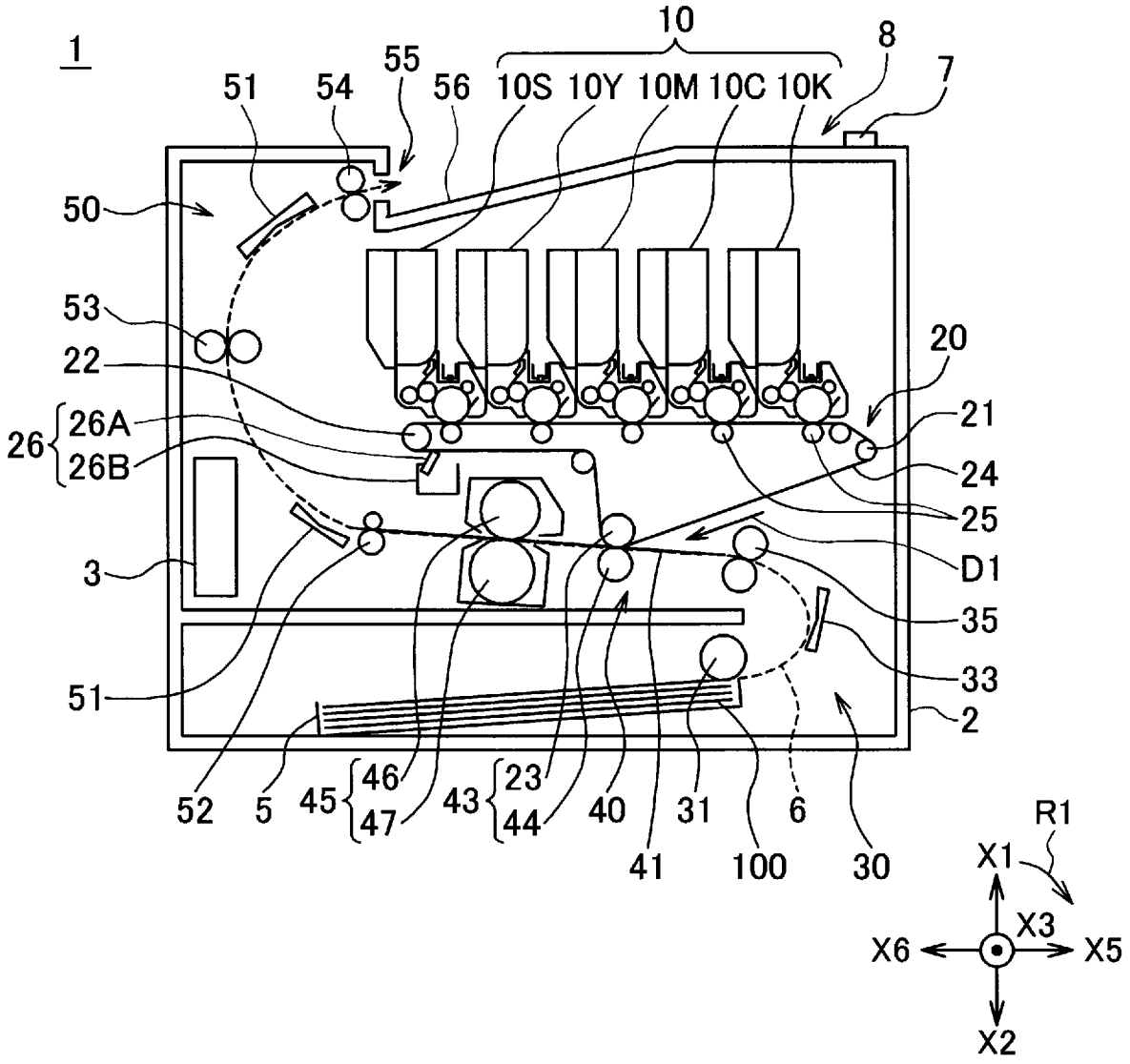
FIG. 1 is a schematic diagram illustrating an overall configuration of an image forming apparatus.

FIG. 1 illustrates an image forming apparatus 1 according to an embodiment. The image forming apparatus 1 is an electrophotographic printer, and is capable of forming (or printing) a color image on a sheet (e.g., paper sheet) 100 as a medium. The image forming apparatus 1 is a single function printer (SFP) having a printer function but having neither an image scanner function of reading a document nor a communication function using telephone lines.

The image forming apparatus 1 includes a substantially box-shaped housing 2, in which various components are disposed. The following description assumes that the right end of the image forming apparatus 1 in FIG. 1 is a front side of the image forming apparatus 1, and an up-down direction, a left-right direction, and a front-rear direction are defined from the perspective of a person facing the front side. In the drawings, the upward, downward, leftward, forward, and rearward directions are indicated by arrows X1, X2, X3, X5, and X6, respectively.

The image forming apparatus 1 includes a controller 3 that entirely controls the image forming apparatus 1. The controller 3 is connected wirelessly or by wire to a host apparatus (not illustrated), such as a computer apparatus. Upon receiving, from the host apparatus, image data representing an image to be printed and a command to print the image data, the controller 3 performs a printing process to form a printed image on a surface of a sheet 100. Also, a display 7 that displays various information and an operation unit 8 that receives an operation from a user are provided on the front side of an upper surface of the housing 2.

Five image forming units 10K, 10C, 10M, 10Y, and 10S are arranged in this order from the front side toward the rear side, on the upper side of the housing 2. The image forming units 10K, 10C, 10M, 10Y, and 10S correspond to colors of black (K), cyan (C), magenta (M), yellow (Y), and silver (S), respectively. Although the image forming units 10K, 10C, 10M, 10Y, and 10S correspond to the different colors, they have the same configuration. Silver (S) is also referred to as a brilliant color. The image forming unit 10S uses silver toner containing flat metallic pigment particles formed by aluminum or the like. The particles have flat surfaces, which reflect light at high reflectance. Thus, the image forming unit 10S is used when it is intended to provide metallic brilliance, for example.

For convenience of description, hereinafter, the image forming units 10K, 10C, 10M, 10Y, and 10S will also be referred to as image forming units 10. Also, hereinafter, the colors other than silver, i.e., the four colors of black (K), cyan (C), magenta (M), and yellow (Y) will be referred to as normal colors. Moreover, hereinafter, the image forming unit 10S for silver will also be referred to as a first image forming unit, and the image forming units 10 (10K, 10C, 10M, and 10Y) for the normal colors will also be referred to as second image forming units.

Figure 2:
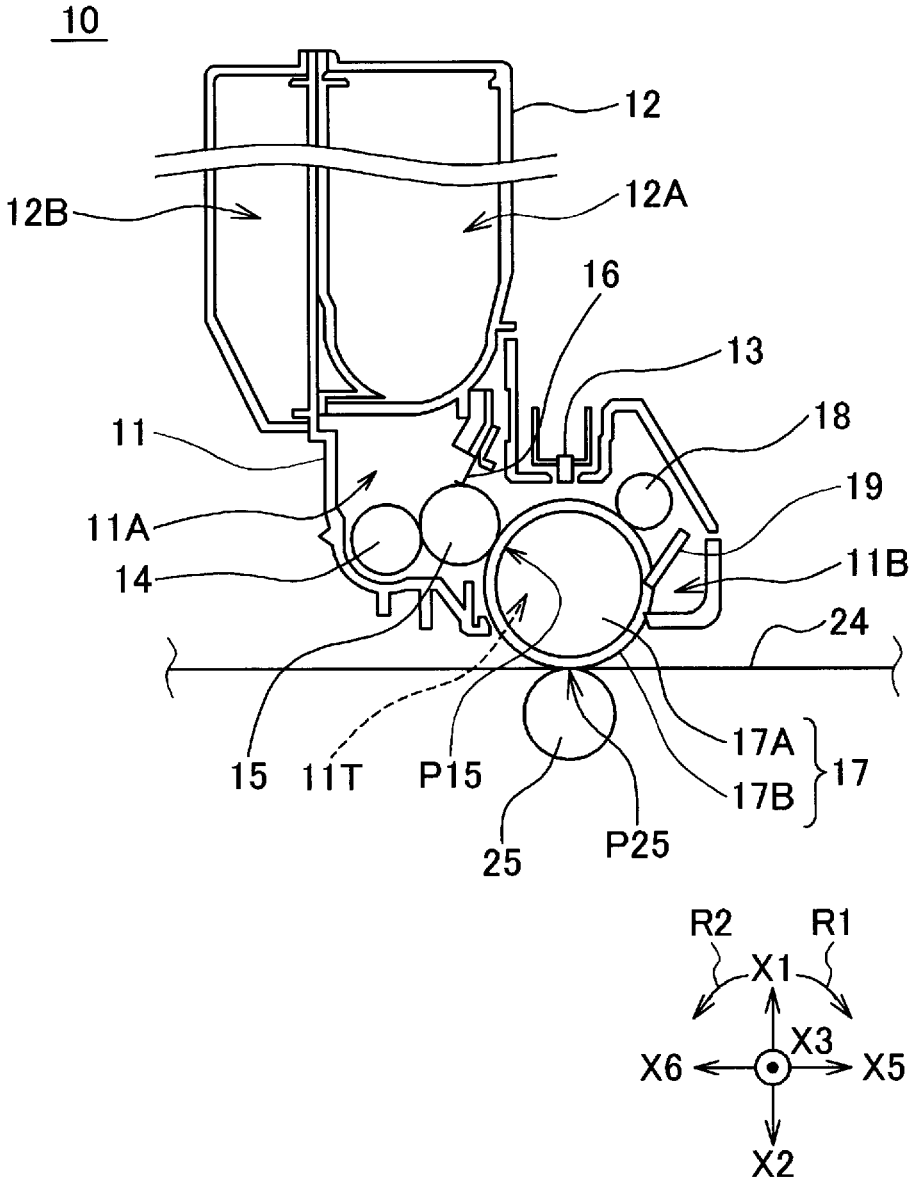
FIG. 2 is a schematic diagram illustrating a configuration of an image forming unit.

Each image forming unit 10 is also referred to as a developing unit, and is constituted by an image forming main portion 11, a toner cartridge 12, and a light emitting diode (LED) head 13, as illustrated in FIG. 2. The LED head 13 is also referred to as an exposure unit, and includes multiple LED chips arranged linearly in the left-right direction.

The toner cartridge 12 is disposed above the image forming main portion 11, and configured to be attachable to and detachable from an upper end portion of the image forming main portion 11. The toner cartridge 12 includes therein a toner storage portion 12A that stores fresh toner and a waste toner storage portion 12B that stores waste toner to be discarded. The toner cartridge 12 supplies the toner stored in the toner storage portion 12A to the image forming main portion 11 and stores waste toner collected by the image forming main portion 11 in the waste toner storage portion 12B. The toner cartridges 12 of the image forming units 10K, 10C, 10M, 10Y, and 10S store toners of black, cyan, magenta, yellow, and silver, respectively.

The image forming main portion 11 includes a supply roller 14, a developing roller 15, a developing blade 16, a photosensitive drum 17, a charging roller 18, and a cleaning blade 19, and has a main body side toner storage space 11A and a main body side waste toner storage space 11B formed therein. The supply roller 14, developing roller 15, photosensitive drum 17, and charging roller 18 are each formed in an elongated solid or hollow cylindrical shape having a central axis extending in the left-right direction, rotatably supported by the image forming main portion 11, and provided with a gear (not illustrated) at one end (e.g., the right end) thereof. Also, the image forming main portion 11 includes a drive transmission unit 11T that is formed by a combination of the respective gears of the supply roller 14 and the like, other gears, and the like, and sequentially transmits a driving force to the supply roller 14 and the like.

The main body side toner storage space 11A is a space located on the rear upper side of the image forming main portion 11, is located substantially directly under the toner storage portion 12A in a state in which the toner cartridge 12 is attached, and stores toner supplied from the toner storage portion 12A. Also, the main body side toner storage space 11A is provided with a toner agitating mechanism (not illustrated) that agitates the stored toner, or the like.

The supply roller 14 includes an elastic layer that is formed by conductive urethane rubber foam or the like and forms a periphery of the roller, and is located on the rear lower side of the main body side toner storage space 11A. The developing roller 15 includes an elastic layer, a conductive surface layer, or the like forming a periphery of the roller, and abuts the front side of the supply roller 14. The developing blade 16 is formed by, for example, a stainless steel sheet having a predetermined thickness, and a portion of the developing blade 16 near its lower end abuts a portion of the periphery of the developing roller 15 near its upper end with the developing blade 16 slightly elastically deformed. Thus, the developing blade 16 can scrape off excess toner deposited on the periphery of the developing roller 15 while the developing roller 15 is rotating, thereby regulating the thickness of the layer of the toner.

The photosensitive drum 17 includes a conductive support 17A and a photoconductive layer 17B. The conductive support 17A is, for example, an aluminum tubular member. The photoconductive layer 17B is, for example, an organic photoreceptor obtained by sequentially stacking a charge generation layer and a charge transport layer on an outer periphery of the conductive support 17A. The photosensitive drum 17 has its lower end portion exposed from the lower side of the image forming main portion 11, and abuts the front side of the developing roller 15.

The charging roller 18 is formed by, for example, covering an outer periphery of a metallic tubular member with a semiconductive epichlorohydrin rubber layer, and abuts the front upper side of the photosensitive drum 17. The cleaning blade 19 is made of, for example, urethane rubber, is formed in a thin plate shape elongated in the left-right direction, and abuts the front lower side of the photosensitive drum 17. Thus, when the photosensitive drum 17 is rotating with toner adhering to the periphery of the photosensitive drum 17, the cleaning blade 19 can scrape off the toner. The main body side waste toner storage space 11B is located on the front lower side of the cleaning blade 19, is a space that is generally closed except for the upper side and rear side, and temporarily stores waste toner scraped off the photosensitive drum 17.

Also, the image forming main portion 11 is provided with a waste toner conveyor (not illustrated). The waste toner conveyor connects the main body side waste toner storage space 11B and the waste toner storage portion 12B of the toner cartridge 12, is installed with a conveying mechanism, and conveys waste toner from the main body side waste toner storage space 11B to the waste toner storage portion 12B.

The image forming main portion 11 is supplied with a driving force from a drive motor 78 to be described later, thereby rotating the supply roller 14, developing roller 15, and charging roller 18 in the direction of arrow R1 (clockwise in FIG. 2) and rotating the photosensitive drum 17 in the direction of arrow R2 (counterclockwise in FIG. 2). Moreover, the image forming main portion 11 applies respective predetermined bias voltages (to be described in detail later) to the supply roller 14, developing roller 15, developing blade 16, and charging roller 18, thereby charging them.

The supply roller 14 is charged to cause toner in the main body side toner storage space 11A to adhere to its periphery, and is rotated to apply the toner to the periphery of the developing roller 15. The developing blade 16 removes excess toner from the periphery of the developing roller 15, and then the periphery is brought into contact with the periphery of the photosensitive drum 17. Hereinafter, a portion where the developing roller 15 abuts the photosensitive drum 17 will be referred to as a developing portion P15.

Meanwhile, the charging roller 18 abuts the photosensitive drum 17 while being charged, thereby uniformly charging the periphery of the photosensitive drum 17. The LED head 13 emits light at predetermined time intervals in a light emitting pattern based on an image data signal supplied from the controller 3 (see FIG. 1), thereby exposing the photosensitive drum 17. Thereby, an electrostatic latent image is formed on the periphery of the photosensitive drum 17, near the upper end of the photosensitive drum 17.

Then, rotation of the photosensitive drum 17 in the direction of arrow R2 brings the portion with the electrostatic latent image formed thereon into contact with the developing roller 15. Thereby, toner adheres to the periphery of the photosensitive drum 17 in accordance with the electrostatic latent image, thereby developing a toner image based on the image data. Further, rotation of the photosensitive drum 17 in the direction of arrow R2 brings the toner image to the vicinity of the lower end of the photosensitive drum 17.

An intermediate transfer unit 20 is disposed below the image forming units 10 in the housing 2 (see FIG. 1). The intermediate transfer unit 20 includes a drive roller 21, a driven roller 22, a secondary transfer backup roller 23, and an intermediate transfer belt 24, five primary transfer rollers 25, and a belt cleaning unit 26. The drive roller 21, driven roller 22, secondary transfer backup roller 23, and primary transfer rollers 25 are each formed in a cylindrical shape having a central axis extending in the left-right direction.

The drive roller 21 is disposed in front of and below the image forming unit 10K, and rotatably supported by the housing 2. The drive roller 21 rotates in the direction of arrow R1 when being supplied with a driving force from a motor (not illustrated). The driven roller 22 is disposed behind and below the image forming unit 10S, and rotatably supported by the housing 2. The upper ends of the drive roller 21 and driven roller 22 are located at the same level as or slightly below the lower ends of the photosensitive drums 17 of the respective image forming units 10. The secondary transfer backup roller 23 is disposed behind and below the drive roller 21 and in front of and below the driven roller 22, and rotatably supported.

The intermediate transfer belt 24 is an endless belt formed by a high-resistance plastic film, and is stretched around the drive roller 21, driven roller 22, and secondary transfer backup roller 23. Moreover, in the intermediate transfer unit 20, the five primary transfer rollers 25 are disposed under a part of the intermediate transfer belt 24 stretched between the drive roller 21 and driven roller 22, more specifically, at positions directly under the five image forming units 10 and facing the photosensitive drums 17 with the intermediate transfer belt 24 therebetween. The primary transfer rollers 25 are rotatably supported by the housing 2, and configured to be applied with predetermined bias voltages.

Hereinafter, portions where the intermediate transfer belt 24 is nipped between the photosensitive drum 17 and the primary transfer rollers 25 will be referred to as primary transfer portions P25 (see FIG. 2).

The belt cleaning unit 26 is disposed in front of and below the driven roller 22, and constituted by a cleaning blade 26A and a waste toner container 26B. The cleaning blade 26A is formed in a thin plate shape elongated in the left-right direction as with the cleaning blades 19 of the image forming units 10 (see FIG. 2), and abuts an outer periphery of the intermediate transfer belt 24. Thus, when the intermediate transfer belt 24 is moving with toner adhering to the outer periphery, the cleaning blade 26A can scrape off the toner. The waste toner container 26B is located in front of and below the cleaning blade 26A, forms a space that is generally closed except for part of the upper side, and stores waste toner scraped off the intermediate transfer belt 24.

The intermediate transfer unit 20 rotates the drive roller 21 in the direction of arrow R1 with a driving force supplied from a sheet conveying motor 77 to be described later, thereby moving the intermediate transfer belt 24 in a direction along arrow D1. Also, each primary transfer roller 25 rotates in the direction of arrow R1 while being applied with a predetermined bias voltage. Thereby, the image forming units 10 can transfer the respective toner images onto the intermediate transfer belt 24 at the primary transfer portions P25 near the lower ends of the peripheries of the photosensitive drums 17 (see FIG. 2), and sequentially superimpose the toner images of the respective colors. At this time, the toner images of the respective colors are superimposed on a surface of the intermediate transfer belt 24 sequentially from the silver toner image on the upstream side. The intermediate transfer unit 20 moves the intermediate transfer belt 24 to convey the toner images transferred from the image forming units, to the vicinity of the secondary transfer backup roller 23.

At this time, in each image forming unit 10 (see FIG. 2), of the toner forming the toner image formed on the periphery of the photosensitive drum 17, toner that has not been transferred onto the intermediate transfer belt 24 is scraped off by the cleaning blade 19 as waste toner, and stored in the main body side waste toner storage space 11B. Then, the waste toner is conveyed by the waste toner conveyor (not illustrated) to the waste toner storage portion 12B of the toner cartridge 12, and stored therein.

On the other hand, a sheet cassette 5 that stores sheets 100 is disposed at a lowermost portion in the housing (see FIG. 1). A sheet feeder 30 is disposed in front of and above the sheet cassette 5. The sheet feeder 30 is constituted by a hopping roller 31 disposed on the front upper side of the sheet cassette 5, a conveying guide 33 that guides a sheet 100 upward along a conveying path 6 (represented by a dashed line in FIG. 1), a pair of registration rollers 35 facing each other with the conveying path 6 therebetween, and the like. FIG. 1 schematically illustrates part of the conveying guide 33.

The sheet feeder 30 picks up the sheets 100 stored in the sheet cassette 5 in a stacked state while separating them one by one, conveys them forward and upward along the conveying path 6 by means of the conveying guide 33, and then converts them rearward and upward to bring them into contact with the pair of registration rollers 35, by appropriately rotating rollers under control of the controller 3. The pair of registration rollers 35, whose rotation is appropriately restricted, exert frictional force on the sheet 100, thereby correcting skew of the sheet 100, in which sides of the sheet 100 are slanted relative to the traveling direction, to place it in a state in which the leading and trailing edges are along the left-right direction, and then feeds the sheet 100 rearward.

An intermediate conveyor 40 is disposed behind the pair of registration rollers 35. The intermediate conveyor 40 forms a portion of the conveying path 6 along in the front-rear direction by means of a conveying guide 41, and a secondary transfer unit 43 is disposed in the portion of the conveying path 6.

In the secondary transfer unit 43, the above-described secondary transfer backup roller 23 of the intermediate transfer unit 20 is disposed above the conveying path 6, and a secondary transfer roller 44 is disposed below the conveying path 6. The secondary transfer roller 44 is formed in a cylindrical shape having a central axis extending in the left-right direction as with the secondary transfer backup roller 23, and is rotatably supported by a support (not illustrated) while being urged upward. Thus, the secondary transfer unit 43 nips the intermediate transfer belt 24 on the conveying path 6 from above and below by means of the secondary transfer backup roller 23 and secondary transfer roller 44. Also, the secondary transfer roller 44 is applied with a predetermined bias voltage. Thus, the secondary transfer unit 43 can transfer the toner images on the intermediate transfer belt 24 onto the sheet 100 and feed the sheet 100 rearward.

A fixing unit 45 is disposed behind the secondary transfer unit 43 (see FIG. 1). The fixing unit 45 is constituted by a heating roller 46 and a pressure roller 47 that face each other with the conveying path 6 therebetween. The heating roller 46 as a heating unit is formed in a cylindrical shape having a central axis extending in the left-right direction, and has a heater, a temperature sensor for detecting a temperature, or the like provided therein. The pressure roller 47 as a pressure unit is formed in a cylindrical shape as with the heating roller 46, and presses its upper surface against a lower surface of the heating roller 46.

The fixing unit 45 heats the heating roller 46 to a predetermined temperature and rotates the heating roller 46 and pressure roller 47 in respective predetermined directions under control of a fixing controller 67 to be described later. Thereby, when the fixing unit 45 receives, from the secondary transfer unit 43, the sheet 100 on which the toner images of the respective colors have been transferred and superimposed, it nips the sheet 100 with the heating roller 46 and pressure roller 47, fixes the toner images to the sheet 100 by applying heat and pressure, and feeds it rearward.

A sheet discharge unit 50 is disposed behind and above the fixing unit 45. The sheet discharge unit 50 is constituted by a conveying guide 51 that guides the sheet 100 upward along the conveying path 6, pairs of conveying rollers 52, 53, and 54 facing each other with the conveying path 6 therebetween, and the like. The sheet discharge unit 50 receives the sheet 100 from the fixing unit 45, conveys it rearward and upward along the conveying path 6, and then conveys it forward and upward to discharge it to a sheet discharge tray 56 through an outlet 55.

As described above, the image forming apparatus 1 forms toner images of the five colors by means of the five image forming units 10, sequentially transfers the toner images onto the intermediate transfer belt 24, transfers the toner images onto a sheet 100 in the secondary transfer unit 43, and fixes the toner images by means of the fixing unit 45, thereby printing an image in the colors including silver on the sheet 100 by an intermediate transfer method.

The silver toner is an example of a brilliant toner containing a flat pigment, and may be referred to as a brilliant toner. Each of the toners of the normal colors is an example of a non-brilliant toner containing no brilliant pigment, and may be referred to as a non-brilliant toner. The toner image of silver is an example of a first toner image, and may be referred to as a first toner image. The toner image of each of the normal colors is an example of a second toner image, and may be referred to as a second toner image. Each photosensitive drum 17 is an example of an image carrier, and may be referred to as an image carrier. The photosensitive drum 17 of the image forming unit 10S for silver is an example of a first image carrier, and may be referred to as a first image carrier. The photosensitive drum 17 of the image forming unit 10 for each of the normal colors is an example of a second image carrier, and may be referred to as a second image carrier. The developing roller 15 of the image forming unit 10S for silver is an example of a first developing member that develops a first toner image on a first image carrier with a brilliant toner containing a flat pigment, and may be referred to as a first developing member. The developing roller 15 of the image forming unit 10 for each of the normal colors is an example of a second developing member that develops a second toner image on a second image carrier with a non-brilliant toner containing no brilliant pigment, and may be referred to as a second developing member. The intermediate transfer belt 24 is an example of a transfer body, and may be referred to as a transfer body. The primary transfer rollers 25 are an example of a transfer unit that transfers the first toner image and the second toner image onto a transfer body, and may be referred to as a transfer unit. The charging roller 18 of the image forming unit 10S for silver is an example of a first charging member that charges the first image carrier, and may be referred to as a first charging member. The charging roller 18 of the image forming unit 10 for each of the normal colors is an example of a second charging member that charges the second image carrier, and may be referred to as a second charging member. The LED head 13 of the image forming unit 10S for silver is an example of a first exposure unit that exposes the first image carrier to form an electrostatic latent image, and may be referred to as a first exposure unit. The LED head 13 of the image forming unit 10 for each of the normal colors is an example of a second exposure unit that exposes the second image carrier to form an electrostatic latent image, and may be referred to as a second exposure unit. The developing blade 16 of the image forming unit 10S for silver is an example of a first toner regulating member that regulates a thickness of a layer of the brilliant toner formed on the first developing member, and may be referred to as a first toner regulating member. The supply roller 14 of the image forming unit 10S for silver is an example of a first supply member that supplies the brilliant toner to the first developing member, and may be referred to as a first supply member. The primary transfer roller 25 corresponding to the image forming unit 10S for silver is an example of a first transfer unit that transfers the first toner image from the first image carrier onto the transfer body, and may be referred to as a first transfer unit. The primary transfer roller 25 corresponding to the image forming unit 10 for each of the normal colors is an example of a second transfer unit that transfers the second toner image from the second image carrier onto the transfer body, and may be referred to as a second transfer unit.

Although the controller 3 is described later in detail, the controller 3 is configured as follows. The following description focuses on one of the second image forming units.

In an aspect, the controller 3 controls the first developing member and the second developing member, and the controller controls a development efficiency of the brilliant toner of the first developing member to be lower than a development efficiency of the non-brilliant toner of the second developing member.

The controller 3 may control a potential difference between a first developing voltage applied to the first developing member and a first charging voltage applied to the first charging member to be less than a potential difference between a second developing voltage applied to the second developing member and a second charging voltage applied to the second charging member.

The controller 3 may control an intensity of exposure by the first exposure unit to be lower than an intensity of exposure by the second exposure unit.

The controller 3 may control an amount per unit area of the brilliant toner deposited on the first developing member. In this case, The controller 3 may control the amount per unit area of the brilliant toner deposited on the first developing member by controlling a combination of magnitudes of voltages applied to the first supply member, the first developing member, and the first charging member.

The controller 3 may control a weight per unit area of the brilliant toner deposited on the first developing member to be not less than 0.84 $mg/cm^2$ and not more than 0.93 $mg/cm^2$.

The controller 3 may control the development efficiency of the brilliant toner of the first developing member to be not less than 38.0% and not more than 80.1%. In this case, the controller 3 may control the development efficiency of the brilliant toner of the first developing member so that a luminous reflectance difference $\Delta Y$ is not more than −20.96, the luminous reflectance difference $\Delta Y$ being a value obtained by subtracting a luminous reflectance of a medium after printing from a luminous reflectance of the medium before printing. The controller 3 may control a weight per unit area of the brilliant toner deposited on the first developing member to be not less than 0.84 $mg/cm^2$ and not more than 0.93 $mg/cm^2$.

In an aspect, when superimposing the first toner image and the second toner image on each other on the transfer body, the controller 3 controls a development efficiency of the brilliant toner of the first developing member to be lower than when forming the first toner image on the transfer body without superimposing the first toner image and the second toner image on each other on the transfer body. In this case, when forming the first toner image on the transfer body without superimposing the first toner image and the second toner image on each other on the transfer body, the controller 3 may perform control so that part of the first toner image on the transfer body is reversely transferred onto the second image carrier at the second transfer unit.

In an aspect, the controller 3 controls bias voltages applied to the first developing member, the first charging member, and the first supply member, and makes a development efficiency of the brilliant toner of the first developing member lower than the development efficiency when the bias voltage applied to the first developing member is −185 V, the bias voltage applied to the first charging member is −1111 V, and the bias voltage applied to the first supply member is −489 V. In this case, the controller 3 may control the development efficiency of the brilliant toner of the first developing member to be not more than 80.1%. The controller 3 may control the development efficiency of the brilliant toner of the first developing member to be not less than 38.0%. The controller 3 may control a weight per unit area of the brilliant toner deposited on the first developing member to be not less than 0.84 $mg/cm^2$ and not more than 0.93 $mg/cm^2$.

2. Circuit Configuration of Image Forming Apparatus

Figure 3:
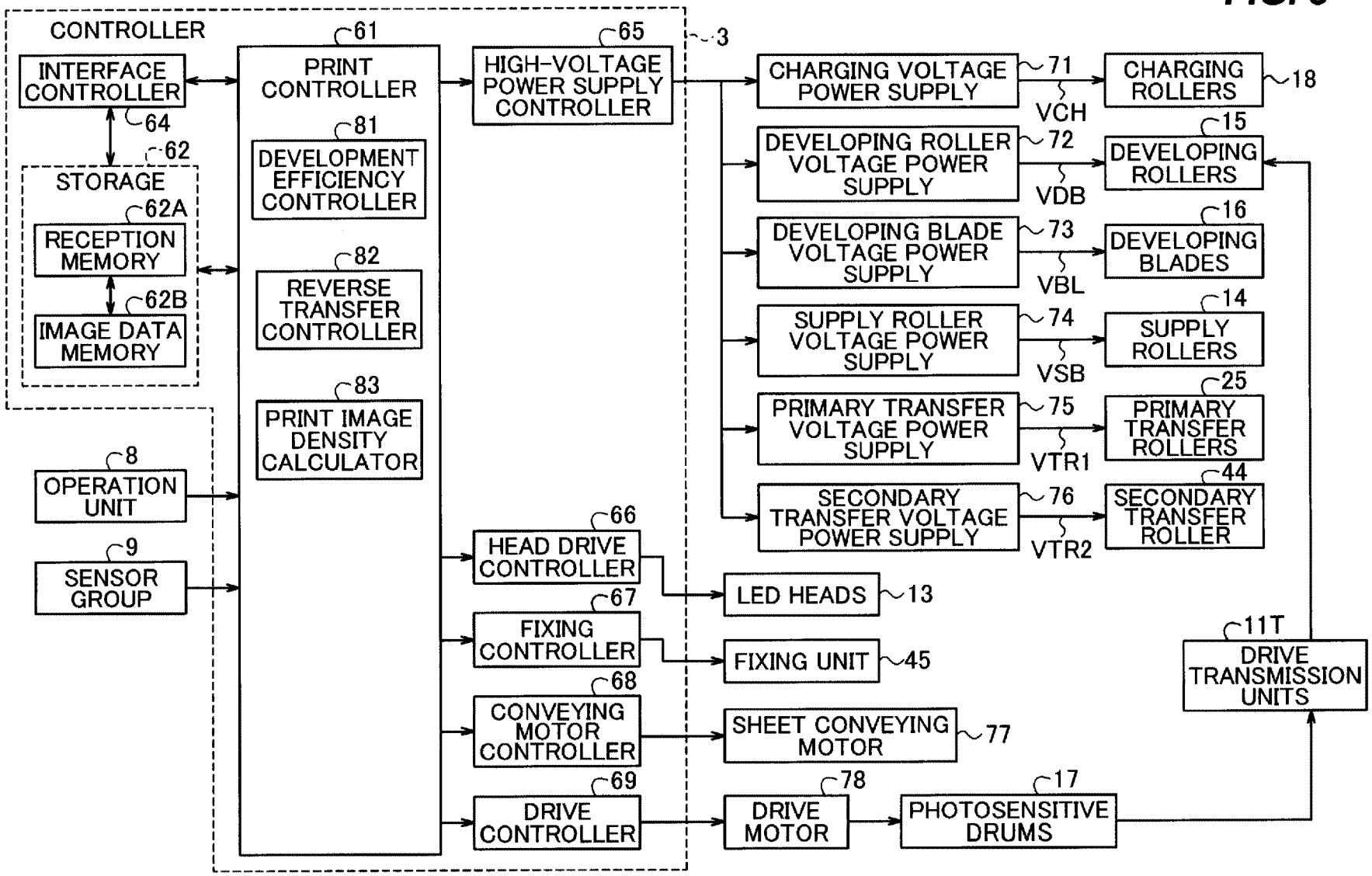
FIG. 3 is a block diagram illustrating a circuit configuration of the image forming apparatus.

Next, a circuit configuration of the image forming apparatus 1 will be described. As illustrated in FIG. 3, the image forming apparatus 1 has a circuit formed around the controller 3. The controller 3 includes a print controller 61, a storage 62, an interface controller 64, a high-voltage power supply controller 65, a head drive controller 66, the fixing controller 67, a conveying motor controller 68, a drive controller 69, and the like.

The print controller 61 includes a processor, such as a central processing unit (CPU) or a microprocessor, a read only memory (ROM), a random access memory (RAM), input/output ports, a timer, and the like, which are not illustrated, and performs various processes by reading a predetermined program from the storage 62 and executing it. Also, the print controller 61 obtains an operation signal from the operation unit 8 and obtains various detection signals from a sensor group 9. The sensor group 9 includes various sensors provided at various positions in the image forming apparatus 1, and detects, for example, the presence or absence of a sheet 100, the temperature and humidity in the apparatus, toner densities of toner images generated by the image forming units 10, the amounts of toner remaining in the toner cartridges 12, and the like.

The storage 62 includes volatile storage means, such as a RAM, and non-volatile storage means, such as a flash memory or a hard disk drive, and stores various information, such as various programs or setting information. Also, the storage 62 includes a reception memory 62A and an image data memory 62B.

The interface controller 64 is connected to the host apparatus (not illustrated) or the like via a predetermined network or the like, receives print data, a control command, or the like from the host apparatus or the like, and supplies it to the print controller 61 or supplies and stores it in the reception memory 62A of the storage 62. The print controller 61 reads print data stored in the reception memory 62A, performs a predetermined editing process to generate image data, stores it in the image data memory 62B, and reads it to supply it to the head drive controller 66.

The high-voltage power supply controller 65 is connected to a charging voltage power supply 71, a developing roller voltage power supply 72, a developing blade voltage power supply 73, a supply roller voltage power supply 74, a primary transfer voltage power supply 75, and a secondary transfer voltage power supply 76, and controls voltages of powers supplied from them on the basis of commands from the print controller 61. The charging voltage power supply 71, developing roller voltage power supply 72, developing blade voltage power supply 73, supply roller voltage power supply 74, primary transfer voltage power supply 75, and secondary transfer voltage power supply 76 supply power to the charging rollers 18, developing rollers 15, developing blades 16, supply rollers 14, primary transfer rollers 25, and secondary transfer roller 44, respectively.

Hereinafter, voltages (i.e., bias voltages) applied to the charging rollers 18, developing rollers 15, developing blades 16, and supply rollers 14 will be referred to as charging roller voltages VCH, developing roller voltages VDB, developing blade voltages VBL, and supply roller voltages VSB, respectively. Also, hereinafter, voltages (i.e., bias voltages) applied to the primary transfer rollers 25 and secondary transfer roller 44 will be referred to as primary transfer roller voltages VTR1 and a secondary transfer roller voltage VTR2, respectively. Moreover, hereinafter, for convenience of description, the charging roller voltage VCH and developing roller voltage VDB in the image forming unit 10S for silver will also be referred to as a first charging voltage and a first developing voltage.

When the head drive controller 66 receives, from the print controller 61, image data read from the image data memory 62B, it supplies the image data to the LED heads 13 and controls the LED heads 13 to cause each LED to emit light in a light emitting pattern based on the image data, in accordance with a command from the print controller 61. The fixing controller 67 controls rotation of the heating roller 46 and pressure roller 47 while controlling the heating roller 46 of the fixing unit 45 at a predetermined temperature, in accordance with a command from the print controller 61.

The conveying motor controller 68 controls the sheet conveying motor 77 in accordance with a command from the print controller 61. Thereby, the sheet conveying motor 77 supplies driving forces to the pair of registration rollers 35 of the sheet feeder 30 (see FIG. 1), the drive roller 21 of the intermediate transfer unit 20, and the pair of conveying rollers 52 of the sheet discharge unit 50, and the like.

The drive controller 69 controls the drive motor 78 in accordance with a command from the print controller 61. Thereby, the drive motor 78 supplies driving forces to the photosensitive drums 17 of the image forming units 10 (see FIG. 2). Also, the photosensitive drums 17 transmit the driving forces to the developing rollers 15 and the like through the drive transmission units 11T of the image forming main portions 11.

Also, the print controller 61 (see FIG. 3) forms therein multiple functional blocks including a development efficiency controller 81, a reverse transfer controller 82, and a print image density calculator 83, by executing a predetermined print program.

The development efficiency controller 81 controls a development efficiency of each of the five image forming units 10. For each image forming unit 10, the development efficiency is a value (%) that represents in percentage the ratio of the amount of toner transferred onto the photosensitive drum 17 relative to the amount of toner deposited on the developing roller 15 before the transfer in a portion of the surface of the photosensitive drum 17 exposed by the LED head 13.

Thus, the development efficiency quantifies the degree of transfer of toner deposited on the developing roller 15 to the photosensitive drum 17 by taking the degree of transfer as an efficiency. Thus, a smaller value of the development efficiency indicates that the degree of transfer is lower, and a larger value of the development efficiency indicates that the degree of transfer is higher.

The development efficiency controller 81 can change the development efficiencies by controlling the charging roller voltages VCH, developing roller voltages VDB, developing blade voltages VBL, supply roller voltages VSB, primary transfer roller voltages VTR1, and secondary transfer roller voltage VTR2 through the high-voltage power supply controller 65. This will be described in detail later. In each of the image forming units 10 for silver and the normal colors, the voltages are normally set so that the development efficiency is about 98%.

Figure 4A:
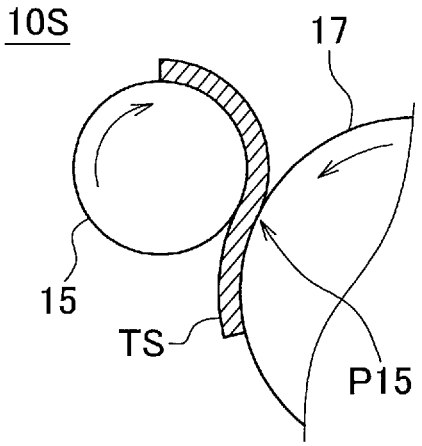
FIGS. 4A and 4B are schematic diagrams illustrating transfer of toner at different development efficiencies.

In the image forming unit 10S for silver, when the development efficiency is relatively high, e.g., about 98%, almost all the toner deposited on the developing roller 15 is transferred to the photosensitive drum 17 at the developing portion P15, as illustrated in FIG. 4A, which illustrates a part of FIG. 2 in an enlarged manner.

Figure 4B:
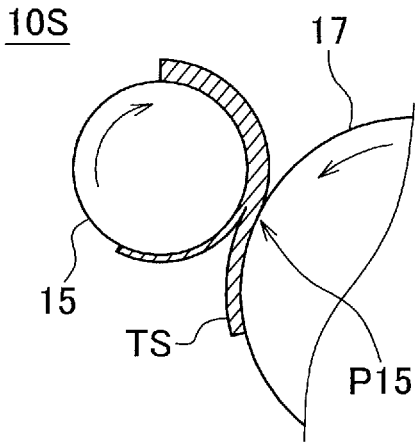

Also, in the image forming unit 10S for silver, when the development efficiency is relatively low, e.g., about 67%, about two-thirds of the toner deposited on the developing roller 15 is transferred to the photosensitive drum 17 at the developing portion P15, and the remaining about one-third remains on the developing roller 15, as illustrated in FIG. 4B, which corresponds to FIG. 4A.

The reverse transfer controller 82 performs control for reverse transfer to transfer toner from the intermediate transfer belt 24 to the photosensitive drums 17 in the image forming units 10 (10K, 10C, 10M, and 10Y) for the respective normal colors.

The reverse transfer is a method of, after transferring a toner image onto the intermediate transfer belt 24 in an image forming unit 10 located on the upstream side in the moving direction of the intermediate transfer belt 24 in the image forming apparatus 1, transferring toner of the toner image from the intermediate transfer belt 24 to the photosensitive drum 17 in another image forming unit 10 on the downstream side.

By using the reverse transfer, the image forming apparatus 1 can reversely transfer part of a toner image on the intermediate transfer belt 24 in an image forming unit 10 on the downstream side, thereby making the layer thickness of the toner image left on the intermediate transfer belt 24 relatively small.

Here, a case where the image forming apparatus 1 prints a silver monochromatic image on a sheet 100 will be described by taking as an example a case where a toner image is transferred onto the intermediate transfer belt 24 in the image forming unit 10S for silver and then part of the toner image is reversely transferred to the photosensitive drum 17 in the image forming unit 10Y for yellow.

Figure 5A:
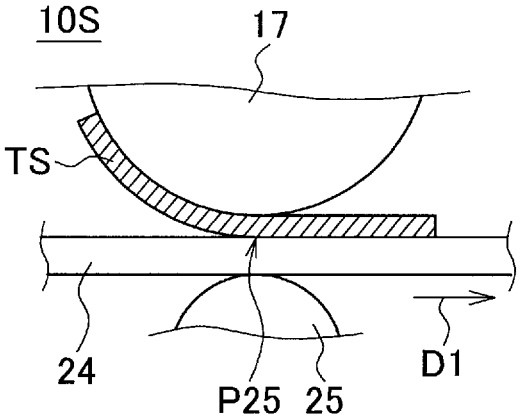
FIGS. 5A and 5B are schematic diagrams illustrating transfer and reverse transfer of toner.

First, as illustrated in FIG. 5A, in the image forming unit 10S on the upstream side, the image forming apparatus 1 forms a silver toner image on the periphery of the photosensitive drum 17, and transfers the toner image onto the intermediate transfer belt 24 at a normal transfer efficiency. Thereby, on the downstream side of the primary transfer portion P25, a toner image having a relatively large layer thickness (i.e., a thick toner image) is formed by silver toner TS on the intermediate transfer belt 24.

Figure 5B:
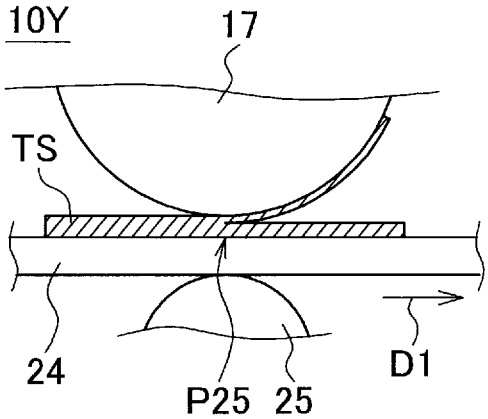

Then, as illustrated in FIG. 5B, in the image forming unit 10Y located downstream of the image forming unit 10S, the image forming apparatus 1 transfers (i.e., reversely transfers) part of the toner image formed by silver toner TS on the intermediate transfer belt 24 to the photosensitive drum 17 by controlling the primary transfer roller voltage VTR1 applied to the primary transfer roller 25.

Then, in the image forming unit 10Y for yellow, the silver toner TS reversely transferred to the photosensitive drum 17 at the primary transfer portion P25 is scraped off as waste toner by the cleaning blade 19, and conveyed to and stored in the waste toner storage portion 12B of the toner cartridge 12. As a result, on the downstream side of the primary transfer portion P25 of the image forming unit 10Y, a toner image having a relatively small layer thickness (i.e., a thin toner image) formed by silver toner TS is left on the intermediate transfer belt 24.

The print image density calculator 83 calculates, for each of the five image forming units 10, i.e., for each toner color, a print image density when a toner image is generated. Here, the print image density is also referred to as a print duty, and is a value (%) that represents in percentage the ratio of pixels at which toner is transferred relative to all the pixels constituting a printable area.

For example, when the rate of the print area (i.e., the coverage rate) is 100%, such as when a solid image is printed on the entire printable area of a predetermined region (such as the periphery of the photosensitive drum or a surface of a print medium), the print image density is 100%. Also, when printing is performed on 1% of the printable area, the print image density is 1%.

The print image density DPD can be expressed by the following equation (1):

$$DPD = \frac{Cm}{Cd \times C0} \times 100. \quad (1)$$

where Cd is the number of revolutions of the photosensitive drum 17, Cm is the number of dots actually used to form an image while the photosensitive drum 17 makes Cd revolutions and is the total number of dots exposed by the LED head 13 (see FIG. 2) while the image is formed, and CO is the total number of dots per revolution of the photosensitive drum 17 (see FIG. 2), i.e., the total number of dots that can be potentially used for image formation during one revolution of the photosensitive drum 17 regardless of whether they are actually exposed. In other words, CO is the total number of dots used in formation of a solid image in which toner is transferred to all the pixels. Thus, the value Cd×CO represents the total number of dots that can be potentially used for image formation during Cd revolutions of the photosensitive drum 17.

As described above, in the image forming apparatus 1, the print controller 61 of the controller 3 can appropriately print an image based on print data, a control command, and the like obtained from the host apparatus, by appropriately controlling each part while cooperating with the controllers such as the high-voltage power supply controller 65.

3. Production of Toner

Next, production of the toners (also referred to as developers) contained in the toner cartridges 12 of the image forming units 10 (see FIG. 2) will be described. In this embodiment, production of the toner of silver, which is a brilliant color, (i.e., a brilliant toner) will be described especially.

As described above, the toner of silver, which is a brilliant color, contains, as a pigment, metallic particles made of aluminum or the like. Hereinafter, the pigment will also be referred to as a metallic pigment or brilliant pigment. The silver toner contains a pigment consisting mainly of flat particles as described above, and exhibits brilliance (or metallic appearance) by reflecting a large amount of light in specific directions at the flat surfaces having relatively large areas. On the other hand, the toner of each normal color contains a pigment consisting mainly of non-flat particles. The particles of the pigment have spherical shapes, elliptical shapes, complicated three-dimensional shapes, or the like, and have no relatively large flat surfaces like those of the flat particles. Thus, the toner of each normal color is relatively low in reflectance. For convenience of description, hereinafter, the silver toner will also be referred to as a flat pigment toner, and the toners of the normal colors will also be referred to as non-flat pigment toners.

Also, in general, developer (or toner) contains, in addition to a pigment for exhibiting a desired color, a binder resin for binding the pigment to a medium, such as a sheet 100, an external additive for improving the chargeability, and the like. For convenience of description, hereinafter, a particle containing a pigment and a binder resin will be referred to as a toner particle, and powder constituted by toner particles will be referred to as toner.

In this embodiment, when the silver toner is produced, an aqueous medium with an inorganic dispersant dispersed therein is first prepared. Specifically, 920 parts by weight of industrial trisodium phosphate dodecahydrate is mixed with 27000 parts by weight of pure water, and dissolved therein at a liquid temperature of 60° C. Then, the resulting liquid is added with dilute nitric acid for pH (hydrogen-ion exponent) adjustment. The resulting aqueous solution is added with an aqueous calcium chloride solution obtained by dissolving 440 parts by weight of industrial calcium chloride anhydride in 4500 parts by weight of pure water, and is high-speed stirred with a Line Mill (manufactured by Primix Corporation) at a rotation speed of 3566 rpm for 34 minutes while being maintained at a liquid temperature of 60° C. Thereby, an aqueous phase that is an aqueous medium with a suspension stabilizer (or inorganic dispersant) dispersed therein is prepared.

Also, in this embodiment, in a process of preparing a resin solution, a pigment dispersion oil medium is prepared. Specifically, a pigment dispersion liquid is prepared by mixing 395 parts by weight of a brilliant pigment (having a volume median size of 5.37 μm) and 60 parts by weight of a charge control agent (BONTRON E-84, manufactured by Orient Chemical Industries Co., Ltd.) with 7430 parts by weight of ethyl acetate, which is an organic solvent. The brilliant pigment contains fine aluminum (Al) flakes, or aluminum small pieces formed in flat plate shapes, flat shapes, or scale shapes. Hereinafter, the brilliant pigment will also be referred to as an aluminum pigment, a metallic pigment, or a silver toner pigment.

It is considered that if the volume median size (also referred to as average particle size, average median size, or pigment particle size) of the brilliant pigment is less than 5 μm, the brilliance of the toner is relatively low, leading to low image brilliance and low image quality. Also, it is considered that if the volume median size of the brilliant pigment is more than 20 μm, it is difficult to include or enclose brilliant pigment particles in toner base particles, which makes it difficult to form developer, and even if developer can be formed using such a brilliant pigment, it is difficult to convey the developer in the image forming apparatus 1, and it is difficult to properly form an image. Thus, the volume median size of the brilliant pigment is preferably not less than 5 μm and not more than 20 μm.

Then, in this embodiment, while being maintained at a liquid temperature of 60° C., the pigment dispersion liquid is added with 60 parts by weight of a charge control resin (FCA-726N, manufactured by Fujikura Kasei Co., Ltd.), 150 parts by weight of an ester wax (WE-4, manufactured by NOF Corporation) as a release agent, and 1310 parts by weight of polyester resin as a binder resin, and is stirred until solid dissolves. Thereby, an oil phase that is a pigment dispersion oil medium is prepared.

Then, in this embodiment, the oil phase is added to the aqueous phase maintained at a liquid temperature of 60° C., and suspended by being stirred for 5 minutes at a rotation speed of 900 rpm, so that particles are formed in a suspension liquid. Then, the ethyl acetate is removed by distilling the suspension liquid under reduced pressure, so that a slurry containing the particles is formed. Then, the slurry is added with nitric acid so that the pH (hydrogen-ion exponent) of the slurry is adjusted to 1.6 or lower, and is stirred. Tricalcium phosphate as a suspension stabilizer is dissolved therein, and the mixture is dehydrated, so that dehydrated particles are obtained. Then, the dehydrated particles are re-dispersed in pure water, stirred, and water-washed. After that, in this embodiment, through dehydration, drying, and classification processes, toner base particles are obtained.

In this embodiment, in an external addition process, the toner base particles thus obtained are added and mixed with 1.5 wt % of small silica (AEROSIL RY200, manufactured by Nippon Aerosil Co., Ltd.), 2.29 wt % of colloidal silica (X-24-9163A, manufactured by Shin-Etsu Chemical Co., Ltd.), and 0.37 wt % of melamine particles (EPOSTAR S, manufactured by NIPPON SHOKUBAI CO., LTD.). In this manner, silver toner having brilliance can be obtained.

4. Control of Toner Deposition Amount

Next, control of a toner deposition amount when a printing process is performed by the image forming apparatus 1 will be described. The toner deposition amount (also referred to as an on-medium deposition amount) refers to the amount per unit area of toner deposited on a medium, such as a sheet 100.

4-1. Definition and Measurement of Various Measured Values

The following describes the definition and measurement of "toner deposition amount", and also describes "fog value", "flop index (FI)", and "luminous reflectance difference" relating thereto.

The definition of "toner deposition amount" will be first described. In this embodiment, the toner deposition amount is defined as the weight per unit area (mg/cm$^2$) of toner deposited on an object, such as a sheet 100, a developing roller 15, and a photosensitive drum 17.

For example, the toner deposition amount on a sheet 100 (also referred to below as an on-sheet toner deposition amount) is determined by measuring the weight of toner deposited on an area of 1 cm$^2$ of the surface of the sheet 100.

In this embodiment, for example, the on-sheet toner deposition amount of brilliant toner is measured and calculated in the following manner.

Figure 6:
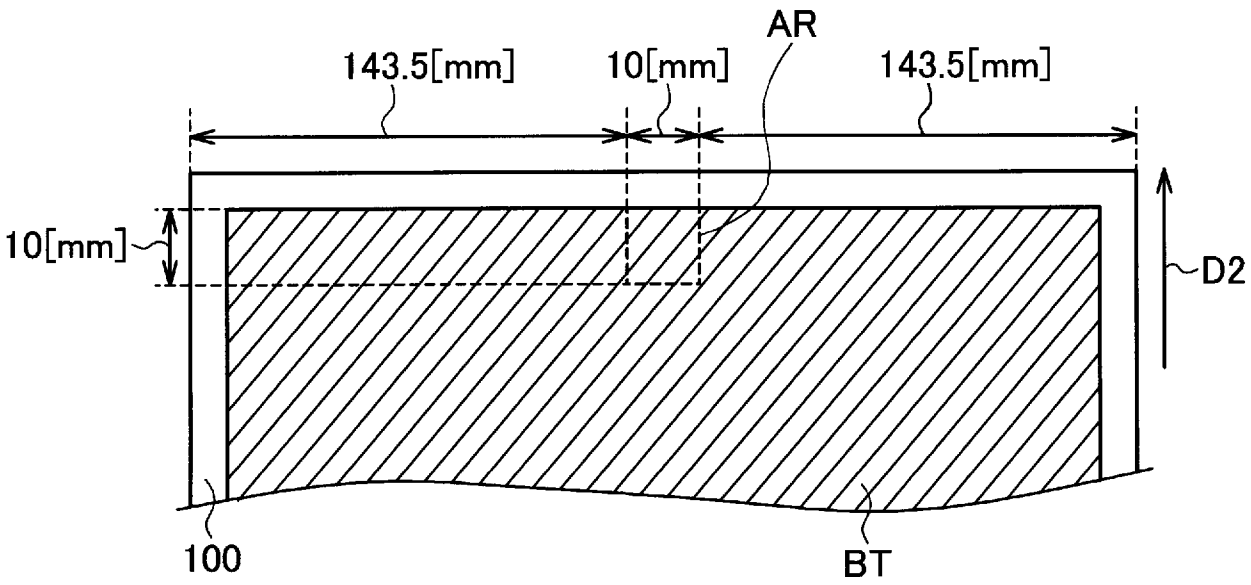
FIG. 6 is a schematic diagram illustrating a measurement region in a solid image pattern.

A metal jig including a planar portion including a portion having an area of 1 cm$^2$ is prepared. A piece of double-sided tape is attached to the 1 cm$^2$ portion of the jig. The weight of the jig in this state is measured using an electric balance (CPA225D, manufactured by Sartorius). Then, a direct-current voltage of +300 V is applied to the jig by using an external power supply. Then, as illustrated in FIG. 6, a medium (which is a sheet 100) on which an image pattern (which is a toner image) having a print image density of 100% (which will be referred to below as a solid image pattern BT) is transferred is prepared. Then, toner on the medium is taken by pressing once the jig to a 10 mm square region (referred to below as a measurement region AR) of the medium located substantially at the center in a main scanning direction and near the leading edge in a medium conveying direction (or a sub-scanning direction) D2. The sheet 100 has a length of 297 mm in the main scanning direction (the left-right direction in FIG. 6), which is equal to the long-side length of an A4 size sheet or the short-side length of an A3 size sheet. Then, the weight of the jig with the toner is measured using the electric balance. Then, the on-sheet toner deposition amount (mg/cm$^2$) is obtained by calculating the difference between the weights before and after the toner sampling.

Also, in this embodiment, the toner deposition amount on a photosensitive drum 17 is measured and calculated in a similar manner. Specifically, a silver toner image (which is a solid image pattern BT) is formed on the periphery of the photosensitive drum 17 in the image forming unit 10S of the image forming apparatus 1, and the rotation of the photosensitive drum 17 is stopped before the toner image is transferred onto the intermediate transfer belt 24. Then, the toner deposition amount is determined by taking and measuring toner deposited on the periphery of the photosensitive drum 17 in this state. Moreover, in this embodiment, the toner deposition amount on a developing roller 15 is measured and calculated in the same manner.

Next, "fog" will be described. Fog refers to a phenomenon in which, in a sheet 100 on which a toner image based on image data is printed, toner adheres to a portion (referred to below as a non-image portion), such as a portion corresponding to a white portion on the image data, on which no toner should be deposited.

The degree of fog can be represented on the basis of the amount of toner adhering to a non-image portion. Also, it is conceivable to measure fog on the basis of, for example, a toner image finally transferred onto a sheet 100, or a toner image formed on the photosensitive drum 17 of an image forming unit 10. Also, it is conceivable not only to measure the degree of fog by directly measuring the amount of toner, but also to indirectly measure the degree of fog on the basis of, for example, the intensity (or amount) or the like of reflected light obtained when a sheet 100 or the like is illuminated with light.

In this embodiment, a value representing the degree of fog is determined by the following method.

First, a printing process based on image data having a print image density of 0% is started by the image forming apparatus 1, and when a toner image is formed on the photosensitive drum 17 of an image forming unit 10, the printing process is forcibly stopped in the middle of the printing process. Ideally, when such image data is printed on a sheet 100, no toner is transferred onto the sheet 100, i.e., nothing is printed on the sheet 100.

Then, toner adhering to the surface of the photosensitive drum 17 is taken by applying a piece of adhesive tape (Scotch Mending Tape, manufactured by Sumitomo 3M Ltd.) to the surface of the photosensitive drum 17 and then peeling it off. Hereinafter, the piece of adhesive tape will be referred to as a sampling tape piece. Then, the sampling tape piece is attached to a white paper sheet (Excellent White, manufactured by Oki Data Corporation). Also, for comparison, a piece of adhesive tape (referred to below as a comparative tape piece) that has not been applied to the photosensitive drum 17 is attached to a portion of the white paper sheet other than the portion of the sampling tape piece.

Then, a sampling lightness Y1 and a comparative lightness Y0 are measured by using a spectrophotometer (CM-2600d, manufactured by KONICA MINOLTA, INC.). The sampling lightness Y1 is a lightness of the portion of the white paper sheet to which the sampling tape piece is attached, and the comparative lightness Y0 is a lightness of the portion of the white paper sheet to which the comparative tape piece is attached. Here, the sampling lightness Y1 is equal to or less than the comparative lightness Y0, and Y1 Y0 holds.

Then, the sampling lightness Y1 is subtracted from the comparative lightness Y0, i.e., the formula Y0-Y1 is calculated, and the resulting value is determined as a fog value ΔE. When the fog value ΔE is small and close to 0, it indicates that the degree of fog is small and the print quality is high. In contrast, when the fog value ΔE is large, it indicates that the degree of fog is large and the print quality is low.

Also, a visual evaluation can be performed for fog. In this embodiment, a printing process based on image data having a print image density of 0% is performed on a sheet 100, which is a white paper sheet, by the image forming apparatus 1, and the degree of fog, i.e., the degree of toner adhesion, on the printed sheet 100 is visually evaluated on a scale of 1 to 10. The evaluation result is referred to as a sheet fog level. A lower sheet fog level indicates that the degree of fog is larger and the image quality is lower, and a higher sheet fog level indicates that the degree of fog is smaller and the image quality is higher.

Next, the flop index (FI) will be described. A higher value of the flop index indicates a higher brilliance, and a lower value of the flop index indicates a lower brilliance. In this embodiment, the flip index (FI) is calculated on the basis of lightness indexes measured by using a variable angle photometer (GC-5000L, manufactured by Nippon Denshoku Industries Co., Ltd.).

Specifically, in this embodiment, with the variable angle photometer, a printed sheet 100 is illuminated with light at an angle of 45° with respect to a normal direction of the sheet 100, light reflected by the sheet 100 is received at angles of 0°, 30°, and −65° with respect to the normal direction, and lightness indexes $L^*_0$, $L^*_{30}$, and $L^*_{-65}$ are calculated from the light reception results. Then, in this embodiment, the flop index FI is calculated by substituting the calculated lightness indexes into the following equation (2):

$$FI = 2.69 \times \frac{(L^*_{30} - L^*_{-65})^{1.11}}{(L^*_0)^{0.86}}. \quad (2)$$

Next, the luminous reflectance difference will be described. The luminous reflectance difference ΔY is a difference value obtained by using two types of luminous reflectances Y that are indexes indicating lightness. Specifically, the luminous reflectance difference ΔY is a difference between a luminous reflectance Y10 of a sheet 100 (which is a white paper sheet) before printing and the luminous reflectance Y11 of the sheet 100 after printing.

The luminous reflectance difference ΔY can be used as an index indicating the degree of metallic appearance (or metallic luster) of an image printed on a sheet 100 with silver (S) toner, and can be measured, for example, by using a spectrophotometer (CM-2600d, manufactured by KONICA MINOLTA, INC.) at a measurement diameter of 8 mm.

4-2. Relationship Between Voltages to Respective Parts and Toner Deposition Amounts Next, the relationship between voltages supplied to respective parts and toner deposition amounts in the image forming units 10 of the image forming apparatus 1 will be described.

For example, in the image forming unit 10S (see FIG. 2) for silver, if the amount of toner supplied from the supply roller 14 to the developing roller 15 is insufficient and the toner layer thickness on the developing roller 15 is relatively small, a gap between the outer periphery of the developing roller 15 and the developing blade 16 is relatively narrow. In this case, in the image forming unit 10S, it is possible that a particle of the brilliant pigment contained in the silver toner is caught and stuck in the gap, and as the developing roller 15 rotates, generates a streak in which no toner is deposited, along the circumferential direction on the outer periphery of the developing roller 15.

In this case, in the image forming unit 10S, also in a toner image formed on the outer periphery of the photosensitive drum 17, a streak in which no toner is deposited is formed along the circumferential direction. Thus, in the image forming apparatus 1, in an image transferred on a sheet 100 in the secondary transfer unit 43, a streak, or a white streak, in which no silver toner is deposited occurs along the conveying direction of the sheet 100.

Thus, in the image forming unit 10S, it is preferable that the toner layer deposited on the periphery of the developing roller 15 have a thickness such that no particle of the brilliant pigment is caught. Various measurements, experiments, and the like (whose detailed description is omitted) have revealed that in the image forming unit 10S, in order to avoid a situation in which no toner is deposited in the form of a streak along the circumferential direction on the periphery of the developing roller 15 (i.e., a situation in which a streak occurs), the toner deposition amount on the developing roller 15 should be not less than 0.84 mg/cm$^2$.

Also, various measurements, experiments, and the like (whose detailed description is omitted) have revealed that in the image forming unit 10S, in order to prevent degradation of image quality due to fog (referred to below as sheet fog) on a sheet 100 on which an image is printed, the toner deposition amount on the developing roller 15 should be not more than 0.93 mg/cm$^2$.

In each image forming unit 10, as described above, by controlling the charging roller voltage VCH, developing roller voltage VDB, supply roller voltage VSB, and the like by means of the development efficiency controller 81 (see FIG. 3), it is possible to change the development efficiency and change the percentage of toner transferred from the developing roller 15 to the photosensitive drum 17 (see FIGS. 4A and 4B). Thus, in each image forming unit 10, by changing the development efficiency, it is possible to change the thickness (or layer thickness) of the toner layer of the toner image formed on the surface of the photosensitive drum 17.

Thus, for example, in the image forming unit 10S, it is possible to regulate the amount of toner transferred onto the photosensitive drum 17 to be relatively small while regulating the toner deposition amount on the developing roller 15 to prevent insufficiency and excess of toner to prevent white streaks and fog.

Examples

Various measurements and evaluations were performed for silver under nine conditions having different development efficiencies, by controlling voltages applied to respective parts, in each of the case where the toner deposition amount on the developing roller 15 was set at 0.84 mg/cm$^2$ and the case where the toner deposition amount on the developing roller 15 was set at 0.93 mg/cm$^2$. The measurements and evaluations were performed by using a color LED printer C941 (manufactured by Oki data Corporation) as the image forming apparatus 1.

Specifically, for the case where the toner deposition amount on the developing roller 15 was set at 0.84 mg/cm$^2$, nine conditions C11 to C19 (collectively referred to below as a first condition group) having different development efficiencies were set. Table T11 of FIG. 7 shows the charging roller voltage VCH, developing roller voltage VDB, supply roller voltage VSB, primary transfer roller voltage VTR1, and secondary transfer roller voltage VTR2 as bias values in the first condition group. Table T11 also shows the difference between the charging roller voltage VCH and the developing roller voltage VDB and the difference between the developing roller voltage VDB and the supply roller voltage VSB, as differences (referred to below as bias differences) between the bias values in the first condition group.

Various measurements and evaluations were performed under each condition of the first condition group. The resulting measured values and evaluation results are shown in table T12 of FIG. 8. Specifically, the measurements and evaluations included measurements of the development efficiency, the toner deposition amount on the photosensitive drum 17, the toner deposition amount on the sheet 100, the fog value ΔE, the luminous reflectance difference ΔY, and the flop index; a visual evaluation of the sheet fog level; and a comprehensive evaluation. The development efficiency is shown also in table T11.

For the comprehensive evaluation, the evaluation result is indicated as "Good" or "Poor". "Good" indicates that it was determined that the amount of toner deposited on the sheet 100 was appropriate and the metallic appearance (also referred to as brilliance or glossiness) was good. On the other hand, "Poor" indicates that it was determined that the amount of toner deposited on the sheet 100 was too small and the metallic appearance was poor with part of the surface of the sheet 100 exposed, or it was determined that the amount of toner deposited on the sheet 100 was too large and the metallic appearance was poor due to diffuse reflection on the surface of the toner deposited on the sheet 100.

Then, for the case where the toner deposition amount on the developing roller 15 was set at 0.93 mg/cm$^2$, nine conditions C21 to C29 (collectively referred to below as a second condition group) having different development efficiencies were set. In each condition of the second condition group, the various voltage values (i.e., the bias values and bias differences) were set as shown in table T21 of FIG. 9, which corresponds to FIG. 7, and various measured values and evaluation results were obtained as shown in table T22 of FIG. 10, which corresponds to FIG. 8.

Tables T11 and T21 show that in the image forming unit 10S, the development efficiency can be reduced by appropriately combining reducing at least one of the charging roller voltage VCH, developing roller voltage VDB, and supply roller voltage VSB, and reducing the bias difference (i.e., potential difference) between charging and developing. Thus, in the image forming unit 10S, although the voltages to the respective parts and other parameters are normally adjusted to set the development efficiency to a maximum efficiency (e.g., about 98%), it is possible to intentionally make the development efficiency lower than the maximum efficiency by appropriately adjusting the voltages to the respective parts.

Figure 11:
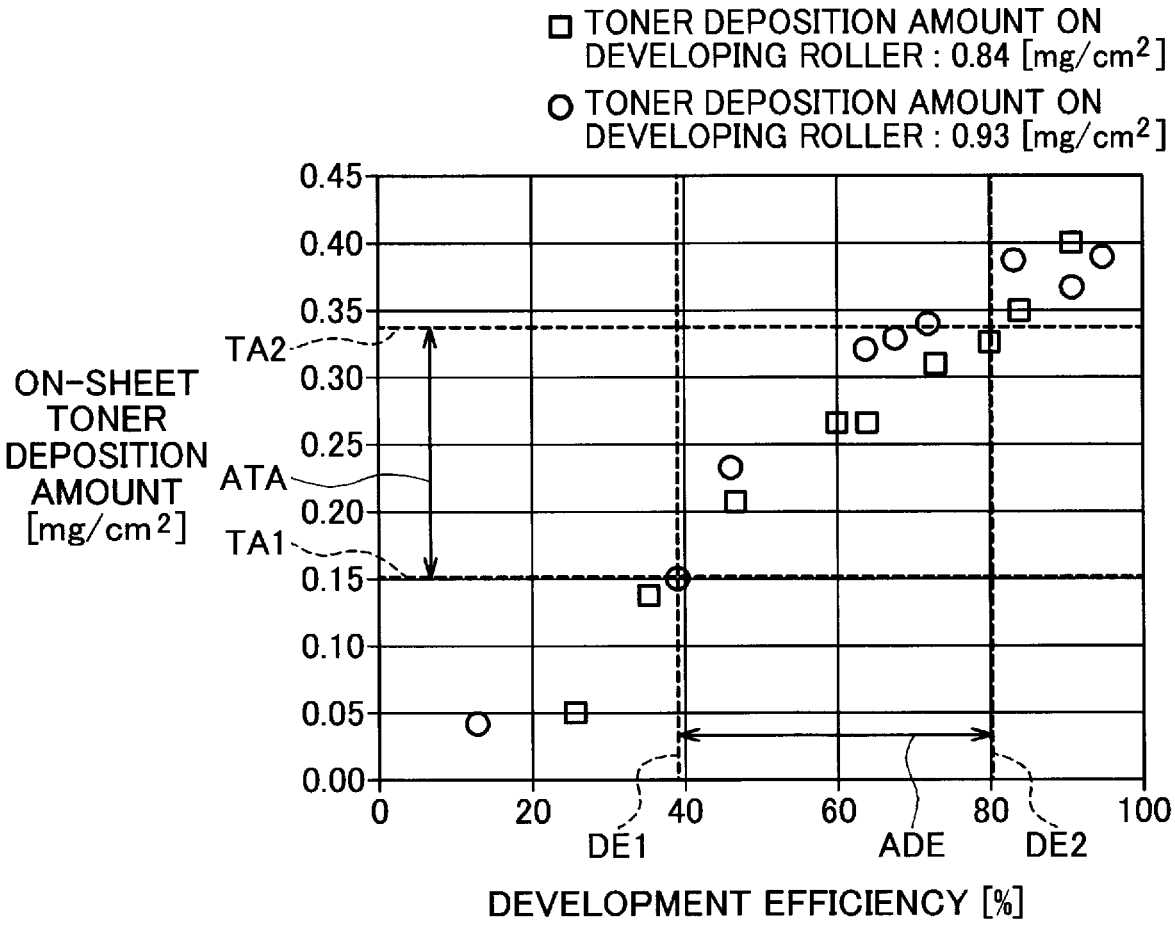
FIG. 11 is a graph showing a relationship between development efficiency and on-sheet toner deposition amount.

Moreover, the graph illustrated in FIG. 11 is obtained by determining the relationship between the development efficiency and the on-sheet toner deposition amount on the basis of the measured values and evaluation results of tables T12 and T22. In FIG. 11, a range of the development efficiency in which the metallic appearance is good is indicated as range ADE, and a lower limit development efficiency DE1 (38.0%) that is a lower limit of range ADE and an upper limit development efficiency DE2 (80.1%) that is an upper limit of range ADE are indicated by dashed lines. Also, in FIG. 11, a range of the on-sheet toner deposition amount corresponding to range ADE is indicated as range ATA, and a lower limit on-sheet toner deposition amount TA1 (0.15 mg/cm$^2$) that is a lower limit of range ATA and an upper limit on-sheet toner deposition amount TA2 (0.34 mg/cm$^2$) that is an upper limit of range ATA are indicated by dashed lines.

In FIG. 11, in range ADE (i.e., in the range in which the development efficiency is 38.0 to 80.1%), more specifically at conditions C13 to C17 and C22 to C26, the evaluation results of the comprehensive evaluations are "Good".

On the other hand, in FIG. 11, in the range in which the development efficiency is lower than the lower limit development efficiency DE1 (38.0%), i.e., at conditions C11, C12, and C21, the evaluation results of the comprehensive evaluations are "Poor". In these cases, the on-sheet toner deposition amount was relatively small, the surface of the medium (i.e., sheet 100) was exposed, the metallic appearance was poor, and thus a rough appearance was visually observed in the printed image. This seems to be due to insufficiency of toner.

Also, in FIG. 11, in the range in which the development efficiency is higher than the upper limit development efficiency DE2 (80.1%), i.e., at conditions C18, C19, C27, C28, and C29, the evaluation results of the comprehensive evaluations are "Poor". In these cases, the metallic appearance was visually determined to be poor. This seems to be due to excess of toner.

As described above, in the image forming unit 10S of the image forming apparatus 1, by regulating the development efficiency in the range of 38.0 to 80.1% while regulating the toner deposition amount on the developing roller 15 in the range of 0.84 to 0.93 mg/cm$^2$, it is possible to regulate the silver toner layer thickness on the sheet 100 to enhance the brilliance while preventing white streaks and fog.

5. Printing Process

Next, a printing process by the image forming apparatus 1 will be described. As described above, in the image forming unit 10S for silver, the image forming apparatus 1 can thin a silver toner image transferred onto the intermediate transfer belt 24 by reducing the development efficiency from the developing roller 15 to the photosensitive drum 17. At this time, in the image forming unit 10S for silver, toner that has not been transferred from the developing roller 15 returns into the main body side toner storage space 11A (see FIG. 2), and adheres to the developing roller 15 again later.

However, in this case, in the image forming unit 10S, each time toner adheres to the developing roller 15, it is subjected to friction with the supply roller 14 and developing blade 16. This may remove external additive particles from the surfaces of toner particles and lower the chargeability of the toner. This may prevent proper transfer of toner at each portion, such as proper development from the developing roller 15 to the photosensitive drum 17.

Also, in the image forming unit 10S, external additive particles removed from the surfaces of toner particles may aggregate and be stuck between the developing roller 15 and the developing blade 16. In this case, in the image forming unit 10S, it is possible that toner is locally scraped off the periphery of the developing roller 15, and a white streak in which toner is lost in the form of a streak occurs in a toner image, as with the case where a toner particle is stuck due to insufficiency of the toner deposition amount on the developing roller 15.

Thus, the image forming apparatus 1 is configured to perform reduction of the development efficiency of the image forming unit 10S for silver (see FIGS. 4A and 4B) and reverse transfer of toner at the image forming units 10 for the respective normal colors (see FIGS. 5A and 5B) in a switching manner, thereby thinning the silver toner image layer while preventing white streaks.

Specifically, the image forming apparatus 1 is configured to, when printing a monochromatic image with only the silver toner, perform reverse transfer at the image forming units 10 for the respective normal colors (i.e., the colors other than silver), and when performing color printing to print an image with a combination of the silver toner and at least one of the normal color toners, reduce the development efficiency of the image forming unit 10S for silver. Specifically, the image forming apparatus 1 is configured to switch the way to adjust the toner deposition amount depending on the types of colors used in the image data.

Figure 12:
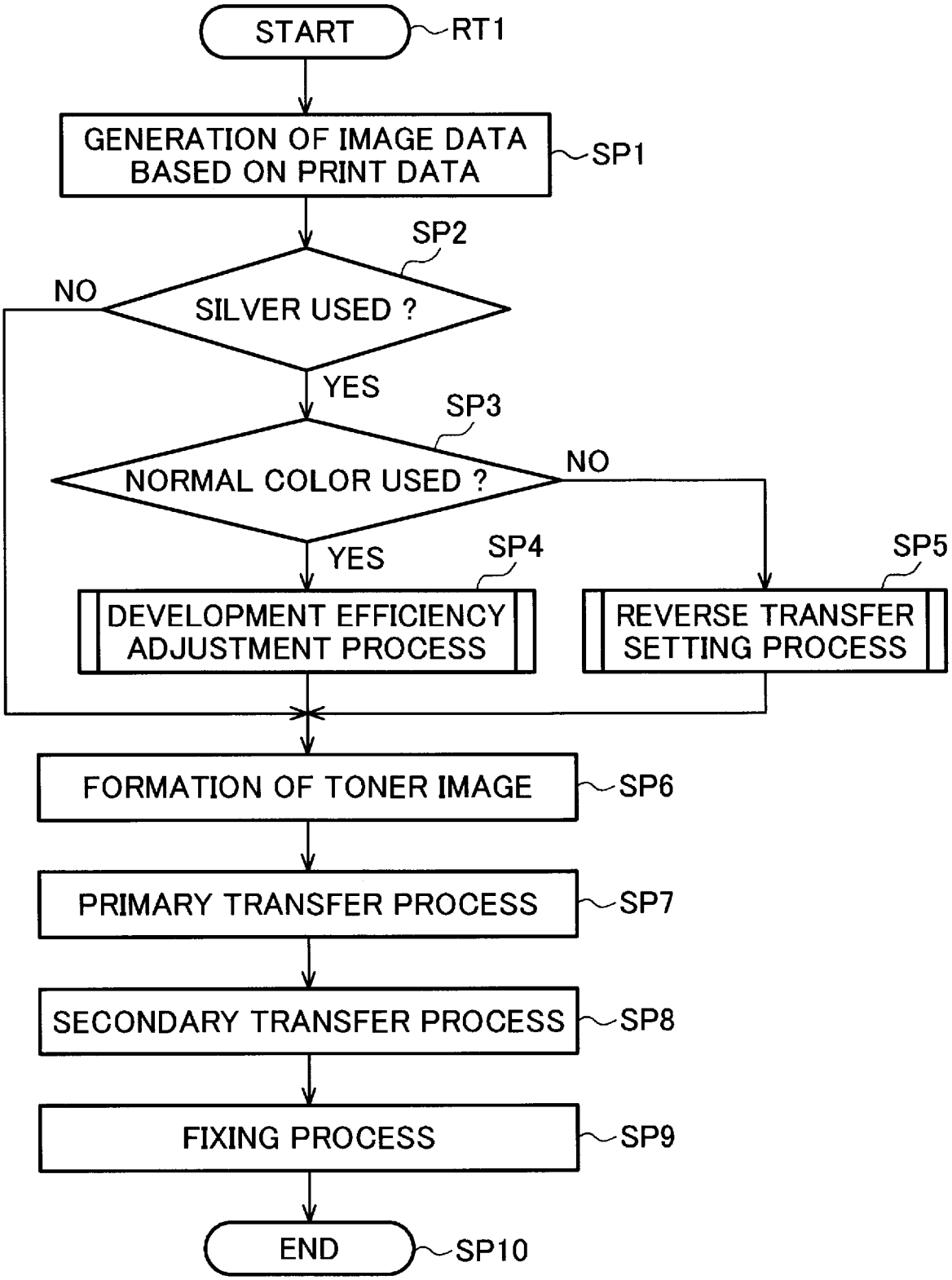
FIG. 12 is a flowchart illustrating a printing process procedure.

Specifically, in performing a printing process, upon receiving print data, a control command, and the like from the host apparatus (not illustrated), the print controller 61 (see FIG. 3) of the image forming apparatus 1 reads the print program from the storage 62 and executes it, thereby starting a printing process procedure RT1 illustrated in FIG. 12 and proceeding to the first step SP1.

In step SP1, the print controller 61 generates image data on the basis of the print data, stores it in the image data memory 62B (see FIG. 3), and proceeds to the next step SP2. In step SP2, the print controller 61 determines whether silver is used in the image data. When the determination is positive, this indicates that it is necessary to perform a process to reduce (or thin) the layer thickness of the silver toner image. At this time, the print controller 61 proceeds to the next step SP3.

In step SP3, the print controller 61 determines whether at least one of the normal colors is used in the image data, i.e., whether the image data includes at least one of black, cyan, magenta, and yellow. When the determination is positive, this indicates that the at least one image forming unit 10 for the at least one normal color located on the downstream side cannot perform the reverse transfer process in the primary transfer process, and thus it is necessary to reduce the development efficiency of the image forming unit 10S for silver. At this time, the print controller 61 proceeds to the next step SP4.

In step SP4, the print controller 61 makes the development efficiency lower than a normal development efficiency by appropriately adjusting the bias values of the image forming unit 10S for silver through the development efficiency controller 81 (FIG. 3), and proceeds to the next step SP6. Specifically, the print controller 61 adjusts the bias values to, for example, the values of condition C15 (see FIG. 7), thereby setting the toner deposition amount on the developing roller 15 to 0.84 mg/cm$^2$ and the development efficiency to 63.5%.

On the other hand, when the determination in step SP3 is negative, this indicates that the image forming units 10 for the respective normal colors located on the downstream side can perform the reverse transfer process in the primary transfer process. At this time, the print controller 61 proceeds to the next step SP5 to perform a setting process required for the reverse transfer process.

In step SP5, the print controller 61 sets the primary transfer roller voltages VTR1 supplied from the primary transfer voltage power supply 75 to the image forming units (10K, 10C, 10M, and 10Y) for the respective normal colors to predetermined reverse transfer voltages, by control by the reverse transfer controller 82 and high-voltage power supply controller 65 (see FIG. 3), and proceeds to the next step SP6. The reverse transfer voltages for the respective normal colors are equal.

Also, when the determination in step SP2 is negative, this indicates that silver is not used in the image data and thus it is not necessary to perform a process for adjusting the silver toner deposition amount. At this time, the print controller 61 proceeds to the next step SP6.

In step SP6, the print controller 61 supplies the image data to the LED heads 13 for the respective colors through the head drive controller 66, drives the drive motor 78 through the drive controller 69, and performs other processes, thereby causing the image forming units 10 to form toner images on the peripheries of the photosensitive drums 17, and proceeds to the next step SP7.

In step SP7, the print controller 61 performs, for each color, the primary transfer process of transferring the toner image from the photosensitive drum 17 of the image forming unit 10 onto the intermediate transfer belt 24, and proceeds to the next step SP8.

When silver and another color is used in the image data, the image forming unit 10S for silver forms a toner image at the reduced development efficiency. Also, when only silver is used in the image data, the image forming unit 10S for silver forms a toner image at the normal development efficiency, and the image forming units 10 for the respective normal colors reversely transfer silver toner from the intermediate transfer belt 24 onto the photosensitive drums 17.

In step SP8, the print controller 61 transfers the toner image(s) from the intermediate transfer belt 24 onto a sheet 100 in the secondary transfer unit 43, and proceeds to the next step SP9. In step SP9, the print controller 61 performs a fixing process to fix the toner image(s) to the sheet 100 by means of the fixing unit 45, and then proceeds to the next step SP10 and ends the printing process procedure RT1.

The printing process procedure RT1 may be changed so that the reverse transfer is not used. Specifically, steps SP3 and SP5 may be removed. In this case, when the determination in step SP2 is positive, the print controller 61 proceeds to step SP4.

6. Advantages, Etc.

In the above configuration, when printing image data using silver, the image forming apparatus 1 according to this embodiment reduces the thickness of the silver layer of the toner image transferred onto the sheet 100 by different methods depending on whether another color is used in the image data. Thereby, the image forming apparatus 1 can increase the percentage of flat brilliant pigment particles having flat surfaces nearly parallel to the sheet surface among the flat brilliant pigment particles contained in the silver toner in the image finally printed on the sheet 100, and can produce a printed product that reflects light well and exhibits high brilliance.

Specifically, when silver and another color are used in the image data, the image forming apparatus 1 reduces the development efficiency at which toner is transferred from the developing roller 15 to the photosensitive drum 17 in the image forming unit 10S for silver. Specifically, the image forming unit 10S makes the potential difference (i.e., bias difference) between the charging roller voltage VCH and the developing roller voltage VDB smaller than a normal potential difference (at which the development efficiency is about 98%), thereby reducing the development efficiency to the range of 38.0 to 80.1%. Also, at this time, the image forming apparatus 1 makes the development efficiency of the image forming unit 10S for silver lower than the development efficiencies (about 98%) of the image forming units 10 for the respective normal colors.

Thereby, in the image forming unit 10S for silver, the image forming apparatus 1 transfers only part of the toner deposited on the developing roller to the photosensitive drum 17, and thus can make the layer thickness of the silver toner image developed on the photosensitive drum 17 relatively small (or thin).

Also, in the image forming unit 10S for silver, the development efficiency is reduced while the toner deposition amount on the developing roller 15 is set to be not less than 0.84 mg/cm$^2$. Thereby, in the image forming unit 10S, the image forming apparatus 1 can make the layer thickness of the toner deposited on the developing roller 15 relatively large and significantly reduce the possibility that a toner particle is caught between the developing roller 15 and the developing blade 16, and thus can prevent white streaks. In addition, in the image forming unit 10S, the development efficiency is reduced while the toner deposition amount on the developing roller 15 is set to be not more than 0.93 mg/cm$^2$. Thereby, it is also possible to prevent fog.

By the way, in the image forming apparatus 1, for an image forming unit 10, in order to reduce the amount of toner finally transferred onto the sheet 100, it is conceivable to reduce the transfer efficiency of the image forming unit 10, i.e., the efficiency at which a toner image is transferred from the photosensitive drum 17 onto the intermediate transfer belt 24.

However, in the image forming unit 10, if the transfer efficiency is reduced, residual toner that has not been transferred from the photosensitive drum 17 to the intermediate transfer belt 24 needs to be scraped off by the cleaning blade 19 and conveyed to and stored in the waste toner storage portion 12B (see FIG. 2). Thus, in the image forming unit 10, if such a method of reducing the transfer efficiency is employed, it is possible that although fresh toner is left in the toner storage portion 12A, the waste toner storage portion 12B is filled with waste toner and the toner cartridge 12 needs to be replaced.

In the image forming unit 10S for silver of this embodiment, when silver and another color is used in the image data, the development efficiency from the developing roller 15 to the photosensitive drum 17 is reduced, but the transfer efficiency to the intermediate transfer belt 24 is not reduced. Thus, in the image forming unit 10S, toner that has not been transferred from the developing roller 15 to the photosensitive drum 17 returns into the main body side toner storage space 11A (see FIG. 2) and adheres to the developing roller 15 again later. Thus, the toner can be effectively reused, and the amount of waste toner stored in the waste toner storage portion 12B is not greatly increased.

As described above, in the image forming apparatus 1, when the development efficiency of the image forming unit 10S for silver is reduced, white streaks may occur due to deterioration of toner around the developing roller 15. Thus, when only silver is used in the image data, the image forming apparatus 1 transfers a toner image onto the intermediate transfer belt 24 at the normal development efficiency and normal transfer efficiency in the image forming unit 10S for silver, and reversely transfers part of the toner image at the image forming units 10 for the respective normal colors located on the downstream side.

Thereby, in the image forming unit 10S for silver, it is possible to develop toner from the developing roller 15 onto the photosensitive drum 17 at the normal development efficiency. Thus, it is possible to greatly reduce deterioration of toner due to being subjected to friction for a long time around the developing roller 15, and prevent white streaks.

Also, at this time, the image forming apparatus 1 can store part of the silver toner image formed in the image forming unit 10S for silver that is not finally left on the intermediate transfer belt 24, as waste toner, in the waste toner storage portions 12B of the image forming units 10 for the other colors. Thus, the image forming apparatus 1 can reduce (or thin) the layer thickness of the silver toner image formed on the intermediate transfer belt 24 almost without increasing the amount of waste toner stored in the waste toner storage portion 12B of the image forming unit 10S for silver.

Thus, when the image data is of a single color of silver, by reversely transferring silver toner from the intermediate transfer belt 24 at the image forming units 10 for the respective colors other than silver, the image forming apparatus 1 can allocate the waste toner to the waste toner storage portions 12B for the respective colors other than silver. Thereby, in the image forming units 10 for the respective colors other than silver, silver waste toner is stored in the waste toner storage portions 12B, and the vacant spaces in the waste toner storage portions 12B can be effectively used.

With the above configuration, when printing image data using silver, the image forming apparatus 1 according to this embodiment reduces the development efficiency of the image forming unit 10S for silver when at least one of the normal colors is used in the image data, and reversely transfers toner at the image forming units 10 for the respective normal colors when no normal color is used. Thereby, the image forming apparatus 1 can reduce the layer thickness of the silver toner image without causing white streaks or fog, and can enhance the brilliance of the image finally printed on the sheet 100 while appropriately preventing the waste toner storage portion 12B for silver from being filled up.

When forming a first toner image on the transfer body without superimposing a second toner image on the first toner image, the image forming apparatus makes the development efficiency of the first developing member relatively high and transfers substantially all the brilliant toner to the first image carrier. Thus, the layer thickness of the first toner image can be made small by collecting part of the brilliant toner from the transfer body at a portion (e.g., a second image forming unit) other than the first image forming unit. Also, when superimposing a second toner image on a first toner image formed on the transfer body, the image forming apparatus makes the development efficiency of the first developing member relatively low and transfers part of the brilliant toner to the first image carrier. Thus, the layer thickness of the first toner image can be made small.

With the embodiment, it is possible to provide an image forming apparatus capable of forming an image having sufficient brilliance in both the case of using only a brilliant toner and the case of superimposing a brilliant toner and a toner of another color.

7. Modifications

The above embodiment adjusts the development efficiency at which toner is transferred from the developing roller 15 to the photosensitive drum 17 by adjusting the charging roller voltage VCH, developing roller voltage VDB, and supply roller voltage VSB. However, this is not mandatory, and for example, it is also possible to adjust the development efficiency by adjusting the amount (or intensity) of light emitted from the LED head 13 (see FIG. 2) to change the degree of exposure. It is also possible to reduce the development efficiency by reducing the amount of light emitted from the LED head 13 to reduce the degree of exposure. The amount of light emitted from the LED head 13 may be adjusted by adjusting at least one of the length of time during which light is emitted from the LED head 13 and the intensity of light emitted from the LED head 13. The controller 3 may control the development efficiency by controlling an image formation condition for forming the first toner image (or silver toner image).

Also, the above embodiment sets the toner deposition amount on the developing roller 15 of the image forming unit 10S for silver to be not less than 0.84 mg/cm$^2$, thereby preventing white streaks. However, this is not mandatory, and for example, in cases such as when the average particle size of the silver toner is different, the toner deposition amount may be set in a range such that white streaks can be prevented in the toner.

Moreover, the above embodiment sets the toner deposition amount on the developing roller 15 of the image forming unit 10S for silver to be not more than 0.93 mg/cm$^2$, thereby preventing fog. However, this is not mandatory, and for example, in cases such as when the charging rate of the silver toner is different, the toner deposition amount may be set in a range such that fog can be prevented in the toner.

Moreover, when no normal color is used in the image data, the above embodiment reversely transfers toner at the image forming units 10 for the respective normal colors at equal rates. However, this is not mandatory. For example, it is also possible to reversely transfer toner according to the ratio, differences, or the like between the amounts of waste toner that can be newly stored in the waste toner storage portions 12B for the respective normal colors. It is also possible to reversely transfer silver toner at only one of the image forming units 10 for the normal colors that can newly store the largest amount of waste toner. Moreover, for example, it is also possible to make the degrees of reverse transfer at the image forming units 10 for the normal colors different from each other, on the basis of the amounts of toner stored (or remaining) in the toner storage portions 12A (see FIG. 2). For example, it is possible, when the amount of toner stored in the toner storage portion 12A for a color is less than a predetermined reference value and the toner cartridge 12 for the color is likely to be replaced before long, to increase the rate of reverse transfer at the image forming unit 10 for the color. Thereby, it is possible to preferentially store waste toner in the waste toner storage portion 12B of the toner cartridge 12 likely to be replaced early and save space in the waste toner storage portions 12B for the other colors.

Moreover, when no normal color is used in the image data, the above embodiment reversely transfers silver toner at the image forming units 10 for the respective normal colors and stores it in the waste toner storage portions 12B without reducing the development efficiency of the image forming unit 10S for silver. However, this is not mandatory, and for example, it is also possible to reduce the development efficiency of the image forming unit 10S for silver, and reversely transfer silver toner at the image forming units 10 for the respective normal colors and store it in the waste toner storage portions 12B.

Moreover, when no normal color is used in the image data, the above embodiment reversely transfers part of the silver toner image transferred on the intermediate transfer belt 24 at the image forming units 10 for the respective normal colors. However, this is not mandatory, and for example, it is also possible, instead of reversely transferring silver toner at the image forming units 10 for the respective normal colors, to reduce the transfer efficiency of the secondary transfer unit 43 located downstream of them, thereby reducing the toner deposition amount of the silver toner image transferred on the sheet 100 and reducing the layer thickness. In this case, for example, it is also possible to move the image forming units 10 for the respective normal colors upward away from the intermediate transfer belt 24 and stop rotation of the photosensitive drums 17 or the like of the image forming units 10 for the respective normal colors, thereby reducing wear of the photosensitive drums 17 or the like. Also, in this case, for example, even when the image forming unit 10S for silver is located on the most downstream side in the moving direction of the intermediate transfer belt 24 in the image forming apparatus 1 (see FIG. 1) and none of the image forming units 10 for the respective normal colors are located downstream of the image forming unit 10S for silver, it is possible to store silver waste toner in a portion other than the waste toner storage portion 12B for silver. Toner that has not been transferred from the intermediate transfer belt 24 to the sheet 100 can be scraped off the intermediate transfer belt 24 by the belt cleaning unit 26 (see FIG. 1). Also, in these cases, in the secondary transfer unit 43, unlike the case of the primary transfer roller voltages VTR1, it is preferable to reduce the secondary transfer roller voltage VTR2 from a normal voltage to reduce the transfer efficiency, thereby reducing the charge amount of the sheet 100 or toner image after the transfer. Moreover, it is also possible to perform reverse transfer at the image forming units 10 for the respective normal colors and reduce the transfer efficiency to the sheet 100 at the secondary transfer unit 43.

Moreover, the above embodiment reduces the toner deposition amount on the intermediate transfer belt 24 of an image of silver toner containing a pigment (specifically a metallic pigment) consisting mainly of flat particles. However, this is not mandatory, and for example, it is also possible to reduce the toner deposition amount on the intermediate transfer belt 24 of an image of a toner of another color, such as gold, having brilliance. It is sufficient that the toner contain a metallic pigment, such as aluminum, and thereby have brilliance. Moreover, it is also possible to reduce the toner deposition amount on the intermediate transfer belt 24 of an image of a toner that contains no metallic pigment but contains a pigment consisting mainly of flat particles.

A gold toner can be produced by, for example, changing part of the production process of the silver toner. Specifically, a gold toner can be produced by, when adding aluminum as a brilliant pigment, adding a yellow pigment (e.g., C.I. Pigment Yellow 180 as an organic pigment), a magenta pigment (e.g., C.I. Pigment Red 122 as an organic pigment), a red orange fluorescent pigment (e.g., FM-34N Orange, manufactured by SINLOIHI CO., LTD.), and a yellow fluorescent pigment (e.g., FM-35N Yellow, manufactured by SINLOIHI CO., LTD.).

Moreover, in the above embodiment, the image forming apparatus 1 is provided with the image forming units 10 for the four colors of black, cyan, magenta, and yellow as the normal colors, in addition to the image forming unit 10S for silver. However, this is not mandatory, and for example, the image forming apparatus 1 may be provided with image forming units 10 for three or less or five or more colors, in addition to the image forming unit 10S for silver. In this case, the colors other than silver may include various colors, such as white or clear (or transparent color), and the toners other than silver toner may be toners containing pigments consisting mainly of non-flat particles.

Moreover, in the above embodiment, the image forming apparatus 1 is of an intermediate transfer system, and transfers toner images formed by the image forming units 10 onto the intermediate transfer belt 24 and transfers the toner images from the intermediate transfer belt 24 onto a sheet 100 at the secondary transfer unit 43. However, this is not mandatory, and for example, the present invention may be applied to a case of directly transferring toner images formed by image forming units 10 onto a sheet 100 in an image forming apparatus of a direct transfer system.

Moreover, in the above embodiment, the interface controller 64 or the like of the controller 3 (see FIG. 3) is configured as hardware circuitry. However, this is not mandatory, and for example, the interface controller 64 or the like of the controller 3 may be implemented by software by executing a predetermined program, as with the development efficiency controller 81 or the like of the print controller 61. Also, the development efficiency controller 81 or the like of the print controller 61 may be implemented by hardware, as with the interface controller 64 or the like. The controller 3 may be processing circuitry. The processing circuitry may be hardware circuitry or a processor that executes a program stored in a memory (e.g., the storage 62) to implement the functions of the controller 3.

Moreover, in the above embodiment, the present invention is applied to the image forming apparatus 1, which is a single function printer. However, this is not mandatory, and for example, the present invention is applicable to other image forming apparatuses having various functions, such as multi-function peripherals (MFPs) having a copy function or a facsimile function.

Moreover, the present invention is not limited to the above embodiment and modifications. Specifically, the scope of application of the present invention extends to embodiments obtained by combining some or all of the features of the above embodiment and modifications, and embodiments obtained by extracting some of the features of the above embodiment and modifications.

Moreover, in the above embodiment, the image forming apparatus 1 as an image forming apparatus is constituted by developing rollers 15 as the first developing member and second developing member, the primary transfer rollers 25 as the transfer unit, and the controller 3 as the controller. However, this is not mandatory, and an image forming apparatus may be constituted by a first developing member, a second developing member, a transfer unit, and a controller that have other configurations.

The present invention can be used, for example, in printing an image of a sheet by forming a toner image with a toner containing a metallic pigment by electrophotography.

What is claimed is:

1. An image forming apparatus comprising:

a first developing member that develops a first toner image on a first image carrier with a brilliant toner containing a flat pigment;

a second developing member that develops a second toner image on a second image carrier with a non-brilliant toner containing no brilliant pigment; and a controller that controls the first developing member and the second developing member, wherein the controller controls a development efficiency of the brilliant toner of the first developing member to be lower than a development efficiency of the non-brilliant toner of the second developing member.

2. The image forming apparatus of claim 1, further comprising:

a first charging member that charges the first image carrier; and a second charging member that charges the second image carrier, wherein the controller controls a potential difference between a first developing voltage applied to the first developing member and a first charging voltage applied to the first charging member to be less than a potential difference between a second developing voltage applied to the second developing member and a second charging voltage applied to the second charging member.

3. The image forming apparatus of claim 1, further comprising:

a first exposure unit that exposes the first image carrier to form an electrostatic latent image; and a second exposure unit that exposes the second image carrier to form an electrostatic latent image, wherein the controller controls an intensity of exposure by the first exposure unit to be lower than an intensity of exposure by the second exposure unit.

4. The image forming apparatus of claim 1, further comprising a first toner regulating member that regulates a thickness of a layer of the brilliant toner formed on the first developing member, wherein the controller controls an amount per unit area of the brilliant toner deposited on the first developing member.

5. The image forming apparatus of claim 4, further comprising:

a first charging member that charges the first image carrier; and a first supply member that supplies the brilliant toner to the first developing member, wherein the controller controls the amount per unit area of the brilliant toner deposited on the first developing member by controlling a combination of magnitudes of voltages applied to the first supply member, the first developing member, and the first charging member.

6. The image forming apparatus of claim 1, wherein the controller controls a weight per unit area of the brilliant toner deposited on the first developing member to be not less than 0.84 $mg/cm^2$ and not more than 0.93 $mg/cm^2$.

7. The image forming apparatus of claim 1, wherein the controller controls the development efficiency of the brilliant toner of the first developing member to be not less than 38.0% and not more than 80.1%.

8. The image forming apparatus of claim 7, wherein the controller controls the development efficiency of the brilliant toner of the first developing member so that a luminous reflectance difference $\Delta Y$ is not more than −20.96, the luminous reflectance difference $\Delta Y$ being a value obtained by subtracting a luminous reflectance of a medium after printing from a luminous reflectance of the medium before printing.

9. The image forming apparatus of claim 7, wherein the controller controls a weight per unit area of the brilliant toner deposited on the first developing member to be not less than 0.84 $mg/cm^2$ and not more than 0.93 $mg/cm^2$.

10. An image forming apparatus comprising:

a first developing member that develops a first toner image on a first image carrier with a brilliant toner containing a flat pigment;

a second developing member that develops a second toner image on a second image carrier with a non-brilliant toner containing no brilliant pigment;

a transfer unit that transfers the first toner image and the second toner image onto a transfer body; and a controller that controls the first developing member and the second developing member, wherein when superimposing the first toner image and the second toner image on each other on the transfer body, the controller controls a development efficiency of the brilliant toner of the first developing member to be lower than when forming the first toner image on the transfer body without superimposing the first toner image and the second toner image on each other on the transfer body.

11. The image forming apparatus of claim 10, wherein the transfer unit includes:

a first transfer unit that transfers the first toner image from the first image carrier onto the transfer body; and a second transfer unit that transfers the second toner image from the second image carrier onto the transfer body, and when forming the first toner image on the transfer body without superimposing the first toner image and the second toner image on each other on the transfer body, the controller performs control so that part of the first toner image on the transfer body is reversely transferred onto the second image carrier at the second transfer unit.

12. An image forming apparatus comprising:

a first developing member that develops a first toner image on a first image carrier with a brilliant toner containing a flat pigment;

a first charging member that charges the first image carrier;

a first supply member that supplies the brilliant toner to the first developing member; and a controller that controls bias voltages applied to the first developing member, the first charging member, and the first supply member, wherein the controller makes a development efficiency of the brilliant toner of the first developing member lower than the development efficiency when the bias voltage applied to the first developing member is −185 V, the bias voltage applied to the first charging member is −1111 V, and the bias voltage applied to the first supply member is −489 V.

13. The image forming apparatus of claim 12, wherein the controller controls the development efficiency of the brilliant toner of the first developing member to be not more than 80.1%.

14. The image forming apparatus of claim 13, wherein the controller controls the development efficiency of the brilliant toner of the first developing member to be not less than 38.0%.

15. The image forming apparatus of claim 12, further comprising a first toner regulating member that regulates a thickness of a layer of the brilliant toner formed on the first developing member, wherein the controller controls a weight per unit area of the brilliant toner deposited on the first developing member to be not less than 0.84 $mg/cm^2$ and not more than 0.93 $mg/cm^2$.

* * * * *